US005853935A

United States Patent [19]

Suzuki et al.

[11] Patent Number: 5,853,935

[45] Date of Patent: Dec. 29, 1998

[54] ELECTROPHOTOGRAPHIC PHOTOCONDUCTOR

[75] Inventors: Tetsuro Suzuki; Tatsuya Niimi; Tomoyuki Shimada, all of Shizuoka, Japan

[73] Assignee: Ricoh Company, Ltd., Tokyo, Japan

[21] Appl. No.: 41,040

[22] Filed: Mar. 12, 1998

[30] Foreign Application Priority Data

| | | | |
|---|---|---|---|
| Mar. 12, 1997 | [JP] | Japan | 9-074639 |
| Mar. 12, 1997 | [JP] | Japan | 9-074645 |
| Mar. 11, 1998 | [JP] | Japan | 10-76436 |
| Mar. 11, 1998 | [JP] | Japan | 10-76437 |

[51] Int. Cl.[6] ..... G03G 5/047; G03G 5/09

[52] U.S. Cl. ..... 430/859; 430/83

[58] Field of Search ..... 430/54, 83

[56] References Cited

U.S. PATENT DOCUMENTS

| | | | |
|---|---|---|---|
| 5,334,470 | 8/1994 | Shimada et al. | 430/59 |
| 5,344,985 | 9/1994 | Tanaka et al. | 564/426 |
| 5,350,653 | 9/1994 | Shoshi et al. | 430/58 |
| 5,436,100 | 7/1995 | Shimada et al. | 430/59 |
| 5,457,232 | 10/1995 | Tanaka et al. | 564/426 |
| 5,459,275 | 10/1995 | Tanaka et al. | 548/145 |
| 5,475,137 | 12/1995 | Shimada et al. | 546/308 |
| 5,486,438 | 1/1996 | Shoshi et al. | 430/58 |
| 5,486,439 | 1/1996 | Sakakibara et al. | 430/59 |
| 5,492,784 | 2/1996 | Yoshikawa et al. | 430/58 |
| 5,576,132 | 11/1996 | Tanaka et al. | 430/59 |
| 5,587,516 | 12/1996 | Tanaka et al. | 564/405 |
| 5,599,995 | 2/1997 | Tanaka et al. | 564/426 |
| 5,604,064 | 2/1997 | Nukada et al. | 430/59 |
| 5,604,065 | 2/1997 | Shimada et al. | 430/83 |
| 5,616,805 | 4/1997 | Tanaka et al. | 564/405 |
| 5,672,728 | 9/1997 | Tanaka et al. | 558/376 |
| 5,672,756 | 9/1997 | Shimada et al. | 564/426 |
| 5,723,243 | 3/1998 | Sasaki et al. | 430/59 |
| 5,736,285 | 4/1998 | Nukada et al. | 430/83 |
| 5,747,204 | 5/1998 | Anzai et al. | 430/83 |

*Primary Examiner*—Roland Martin

*Attorney, Agent, or Firm*—Oblon, Spivak, McClelland, Maier & Neustadt, P.C.

[57] ABSTRACT

An electrophotographic photoconductor has an electroconductive support, and a photoconductive layer formed thereon containing a polycarbonate resin with a triarylamine structure on the main chain and/or side chain thereof, which serves as a high-molecular weight charge transport material, and at least as a charge generation material an azo compound of formula (1) or (2) specified in the specification.

16 Claims, 1 Drawing Sheet

ELECTROPHOTOGRAPHIC PHOTOCONDUCTOR

BACKGROUND OF THE INVENTION

1. Field of the Invention

The present invention relates to an electrophotographic photoconductor with high sensitivity and minimum residual potential, and excellent repetition durability for an extended period of time.

2. Discussion of Background

The Carlson process and other processes obtained by modifying the Carlson process are conventionally known as the electrophotographic methods, and widely utilized in the copying machine and printer. In a photoconductor for use with the electrophotographic method, an organic photoconductive material is now widely used because such an organic photoconductor can be manufactured at low cost by mass production, and causes no environmental pollution.

Many kinds of organic photoconductors are conventionally proposed, for example, a photoconductor employing a photoconductive resin such as polyvinylcarbazole (PVK); a photoconductor comprising a charge transport complex of polyvinylcarbazole (PVK) and 2,4,7-trinitrofluorenone (TNF); a photoconductor of a pigment dispersed type in which a phthalocyanine pigment is dispersed in a binder resin; and a function-separating photoconductor comprising a charge generation material and a charge transport material. In particular, the function-separating photoconductor has now attracted considerable attention.

The mechanism of the formation of latent electrostatic images on the function-separating photoconductor is as follows:

When the photoconductor is charged to a predetermined polarity and exposed to light, the light passes through a transparent charge transport layer, and is absorbed by a charge generation material in a charge generation layer. The charge generation material generates charge carriers by the absorption of light. The charge carriers generated in the charge generation layer are injected into the charge transport layer, and move in the charge transport layer depending on the electric field generated by the charging process. Thus, latent electrostatic images are formed on the surface of the photoconductor by neutralizing the charge thereon. As is known, it is effective that the function-separating electrophotographic photoconductor employ in combination a charge transport material having an absorption intensity mainly in the ultraviolet region, and a charge generation material having an absorption intensity mainly in a range from the visible region extending to the near infrared region.

To obtain the above-mentioned function-separating electrophotographic photoconductor, the particular charge generation materials are proposed, as disclosed in Japanese Laid-Open Patent Applications 64-2146, 54-22834, 5-32905, and 8-209007. Although those conventional charge generation materials are remarkably effective and the thus obtained photoconductors show high sensitivity, such performance deteriorates when the photoconductor is repeatedly used for an extended period of time.

As the charge transport materials, on the other hand, many low-molecular weight compounds have been developed. However, the film-forming properties of such a low-molecular weight compound are very poor, so that the low-molecular weight charge transport material is dispersed and mixed with an inert polymer to prepare a charge transport layer. The charge transport layer thus prepared using the low-molecular weight charge transport material and the inert polymer is generally so soft that the charge transport layer is easily scraped off during the repeated electrophotographic operations by the Carlson process. As a result, there occur the problems of decrease in charging potential and deterioration in photosensitivity. Thus, not only abnormal images such as black stripes will appear due to the scratch on the photoconductor, but also the toner deposition on the background and the decrease of image density will occur.

In addition, when the photoconductive layer or the charge transport layer comprises the above-mentioned low-molecular weight charge transport material, the charge mobility has its limit therein. This is because the low-molecular weight charge transport material is contained in the photoconductive layer or the charge transport layer in an amount of 50 wt. % at most. The Carlson process cannot be accordingly carried out at high speed, and the size of electrophotographic apparatus cannot be decreased. The charge mobility can be improved by increasing the amount of such a low-molecular weight charge transport material. In such a case, however, the film-forming properties of the photoconductive layer or charge transport layer deteriorate.

To solve the above-mentioned problems of the low-molecular weight charge transport material, considerable attention has been paid to a high-molecular weight charge transport material. A variety of high-molecular weight charge transport materials are proposed, for example, as disclosed in Japanese Laid-Open Patent Applications Nos. 51-73888, 54-8527, 54-11737, 56-150749, 57-78402, 63-285552, 1-1728, 1-19049 and 3-50555.

When the above-mentioned high-molecular weight charge transport material is used in the photoconductive layer, the photosensitivity is considerably inferior to that of the photoconductor employing the low-molecular weight charge transport material.

Each of the previously mentioned charge generation materials disclosed in Japanese Laid-Open Patent Applications 54-22834 and 5-32905 is capable of generating photocarriers when sensitized by the charge transport material. In other words, the generation of photocarriers is extrinsically induced. The generating efficiency of photocarriers by the charge generation material slightly decreases when the charge generation material is used together with the above-mentioned high-molecular weight charge transport material as compared with the low-molecular charge transport material. In this case, therefore, it is necessary to add a small amount of low-molecular weight charge transport material to the charge transport layer. High abrasion resistance of the charge transport layer, which is obtained by the presence of the high-molecular weight charge transport material in the charge transport layer, is accordingly reduced.

The charge generation material disclosed in Japanese Laid-Open Patent Application 8-209007 has a moiety (substituent), in its molecule, capable of transporting the charge. Namely, this type of charge generation material can intrinsically generate the photocarriers without the application of any extrinsical factor thereto. Therefore, there is no decrease in the generating efficiency of photocarriers even though such a charge generation material is used in combination with the high-molecular weight charge transport material in the photoconductive layer. However, there is another problem of the high-molecular weight charge transport material that the residual potential of the photoconductor increases during the repeated electrophotographic operations.

SUMMARY OF THE INVENTION

Accordingly, an object of the present invention is to provide an electrophotographic photoconductor with high sensitivity and minimum residual potential, and in addition, such a sufficient abrasion resistance that can prevent the photoconductive layer from being scraped off during the repeated electrophotographic operations.

The above-mentioned object of the present invention can be achieved by an electrophotographic photoconductor comprising an electroconductive support, and a photoconductive layer formed thereon which comprises a polycarbonate resin comprising a triarylamine structure on the main chain and/or side chain thereof, and at least one charge generation material selected from the group consisting of an azo compound represented by formula (1):

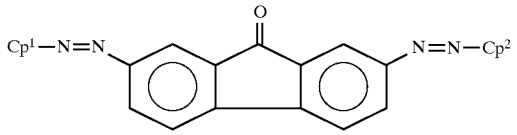

(1)

wherein $Cp^1$ and $Cp^2$ are each a coupler radical which may be the same or different, provided that at least $Cp^1$ or $Cp^2$ is a coupler radical component represented by formula (1-a);

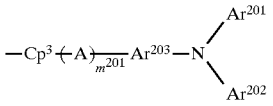

(I-a)

in which $Cp^3$ is a bivalent coupler radical; $Ar^{201}$ and $Ar^{202}$ are each an aryl group which may have a substituent; $Ar^{203}$ is an arylene group which may have a substituent; A is ethylene group, vinylene group, oxygen atom or sulfur atom; and $m^{201}$ is an integer of 0 to 2; and an azo compound represented by formula (2):

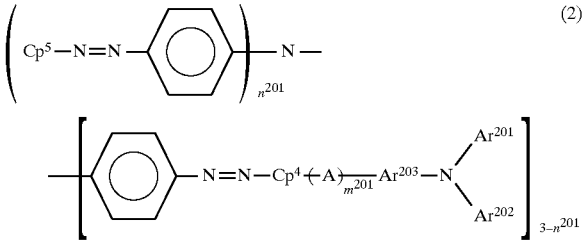

(2)

wherein $Cp^4$ is a bivalent coupler radical; $Cp^5$ is a monovalent coupler radical; $Ar^{201}$, $Ar^{202}$, $Ar^{203}$, A and $m^{201}$ are the same as those as previously defined in formula (1-a); and $n^{201}$ is an integer of 0 to 2.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
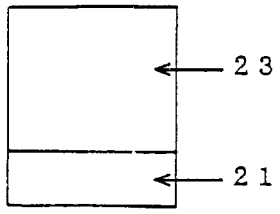
FIG. 1 is a schematic cross-sectional view which shows one example of an electrophotographic photoconductor according to the present invention.

The electrophotographic process has been developed in recent years with the stress being laid on the decrease of size of the electrophotographic apparatus and the increase of operating speed in the electrophotographic process. In line with such tendency, there are increasing demands for sufficient durability of the electrophotographic process and high sensitivity of an electrophotographic photoconductor used therein. In addition, the electrophotographic photoconductor which can be incorporated in the electrophotographic apparatus without any replacement and maintenance is desired from ecological viewpoint. Thus, to improve the durability of electrophotographic process and photoconductor is of great significance.

In terms of durability of the photoconductor, as previously mentioned, the high-molecular weight charge transport material is conventionally employed in the charge transport layer to improve the mechanical properties, that is, the abrasion resistance, of the photoconductor. However, after this kind of photoconductor is repeatedly used for an extended period of time, the electrostatic properties become poorer and the residual potential becomes higher as compared with those of the photoconductor comprising a charge transport layer of a low-molecular weight charge transport material dispersed type.

The above-mentioned problems of the electrostatic properties and the residual potential become more serious when such a high-molecular weight charge transport material is used in combination with the charge generation material such as an azo pigment or a perylene pigment, which generates photocarriers by being extrinsically sensitized. The azo pigment has a particularly great potential as the charge generation material because of easy modification in chemical structure thereof. In light of a great potential of the azo pigment, the inventors of the present invention have studied the process of generating photocarriers by the azo pigment, and consequently, found the photocarriers to be generated by the mutual action between a molecule of the azo pigment and that of the charge transport material. It has also been discovered in a function-separating laminated photoconductor that the molecule of the azo pigment can come in contact with the molecule of the charge transport material when the charge transport layer is provided on the charge generation layer by wet-type coating method. To be more specific, the charge transport material contained in a coating liquid for the charge transport layer permeates through the charge generation layer, and comes in contact with the azo pigment in the charge generation layer. When the charge transport layer is formed by such wet-type coating method, the high-molecular weight charge transport material can scarcely pass through the charge generation layer because of such a high molecular weight.

Understandably, therefore, the reason why the photoconductor employing the azo pigment and the high-molecular weight charge transport material produces the previously mentioned conventional problems is that the molecules of both materials cannot sufficiently come in contact with each other.

It has been supposed that the azo pigment can generate photocarriers by the previously mentioned intrinsical mechanism namely, without the application thereto of any external factor if the molecule of a charge transport material is chemically bonded to the molecule of the azo pigment.

In the present invention, an electrophotographic photoconductor is fabricated using (i) an azo pigment with formula (1) or (2) which is synthesized so that the charge transporting moiety of a charge transport material may be bonded thereto, and (ii) a high-molecular weight charge transport material. The molecule of the azo pigment thus synthesize shows sufficient capability of generating photocarriers by itself. Further, even though the high-molecular weight charge transport material is contained in the charge transport layer of a laminated type photoconductive layer, sufficient photosensitivity and low residual potential can be maintained. In addition, since it is not necessary to add any low-molecular weight charge transport material to the charge transport layer, the charge transport layer thus obtained can be provided with excellent abrasion resistance which is characteristic of the high-molecular weight charge transport material.

The stability of the electrophotographic process can be enhanced, with high abrasion resistance of the photoconductor being maintained in the repeated operations when such an azo pigment with the charge transporting moiety is used in combination with the particular high-molecular weight charge transport material.

In the electrophotographic photoconductor of the present invention, the photoconductive layer comprises a specific high-molecular weight charge transport material. The advantages obtained by using such a high-molecular weight charge transport material in the photoconductor are as follows:

(1) High abrasion resistance can be obtained. The abrasion resistance of the charge transport layer comprising the high-molecular weight charge transport material, which depends on the kind of high-molecular weight charge transport material to be employed, will be several times that of the charge transport layer in which the low-molecular weight charge transport material is dispersed in a binder resin.

(2) The density of charge transporting site can be increased. In the charge transport layer prepared by dispersing a low-molecular weight charge transport material in a binder resin, the amount of low-molecular weight charge transport material cannot be excessively increased in light of the mechanical strength of the obtained charge transport layer. This is because the higher the concentration of the low-molecular weight charge transport material in the charge transport layer, the lower the abrasion resistance thereof.

In contrast to this, the high-molecular weight charge transport material is originally provided with film-forming properties, and in addition, such a sufficient abrasion resistance as to be used as a binder resin. Therefore, the density of the charge transporting site, for example, a triarylamine moiety in the high-molecular weight charge transport material for use in the present invention, can be extremely increased. The phenomenon of image blurring, which occurs in the charge transport layer of the low-molecular weight charge transport material dispersed type because of the diffusion of photocarriers, can be accordingly prevented.

(3) The hardness of the obtained photoconductor is remarkably high. For instance, in the laminated photoconductive layer for use in the present invention, the charge transport layer is substantially made of polymers. Although various additives may be contained in the charge transport layer when necessary, the concentration of the polymeric materials in the charge transport layer is not comparable with that in the charge transport layer where the low-molecular weight charge transport material is dispersed in the binder resin. Therefore, sufficient hardness can be imparted to the photoconductor. Such a photoconductor with high hardness is considered to be very advantageous when used in the electrophotographic process because pressure is applied to many portions of the photoconductor throughout the electrophotographic process.

The structure of the electrophotographic photoconductor according to the present invention will now be explained in detail by referring to FIGS. 1 through 3.

FIG. 1 is a cross-sectional view which shows one example of an electrophotographic photoconductor according to the present invention. In this photoconductor, a photoconductive layer 23 is provided on an electroconductive support 21.

Figure 2:
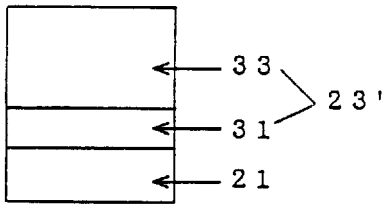
FIG. 2 is a schematic cross-sectional view which shows another example of an electrophotographic photoconductor according to the present invention.

In an electrophotographic photoconductor of FIG. 2, a photoconductive layer 23' comprises a charge generation layer 31 and a charge transport layer 33, which are successively overlaid on the electroconductive support 1 in this order.

Figure 3:
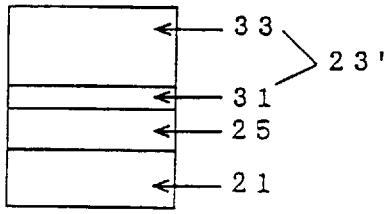
FIG. 3 is a schematic cross-sectional view which shows a further example of an electrophotographic photoconductor according to the present invention.

FIG. 3 shows still another example of the electrophotographic photoconductor according to the present invention. In this figure, an intermediate layer 25 is interposed between an electroconductive support 21 and a photoconductive layer 23'.

The electroconductive support 21 may exhibit electroconductive properties, for example, have a volume resistivity of $1\times10^{10}$ Ω·cm or less. The electroconductive support 21 can be prepared by coating metals such as aluminum, nickel, chromium, nichrome, copper, silver, gold, platinum and iron, or metallic oxides such as tin oxide and indium oxide on a plastic film or a sheet of paper, which may be in the cylindrical form, by deposition or sputtering method. Alternatively, a plate of aluminum, aluminum alloys, nickel, or stainless steel may be formed into a tube by drawing and ironing (D.I.) method, impact ironing (I.I.) method, extrusion or pultrusion method. Subsequently, the tube thus obtained may be subjected to surface treatment such as cutting, superfinishing or abrasion to prepare the electroconductive support 21 for use in the photoconductor of the present invention.

The photoconductive layer for use in the electrophotographic photoconductor may be of a single-layered type as shown in FIG. 1, or of a laminated type in FIG. 2.

First, the laminated photoconductive layer 23' will be explained in detail with reference to FIG. 2.

The charge generation layer 31 for use in the laminated photoconductive layer 23' comprises at least one charge generation material selected from the group consisting of an azo compound represented by formula (1):

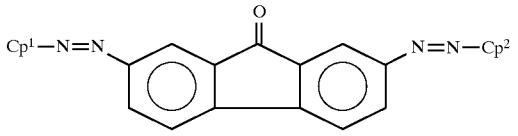

(1)

wherein $Cp^1$ and $Cp^2$ are each a coupler radical which may be the same or different, provided that at least $Cp^1$ or $Cp^2$ is a coupler radical component represented by formula (1-a);

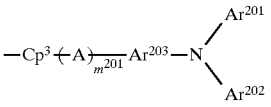

(I-a)

in which $Cp^3$ is a bivalent coupler radical; $Ar^{201}$ and $Ar^{202}$ are each an aryl group which may have a substituent; $Ar^{203}$ is an arylene group which may have a substituent; A is ethylene group, vinylene group, oxygen atom or sulfur atom; and $m^{201}$ is an integer of 0 to 2; and an azo compound represented by formula (2):

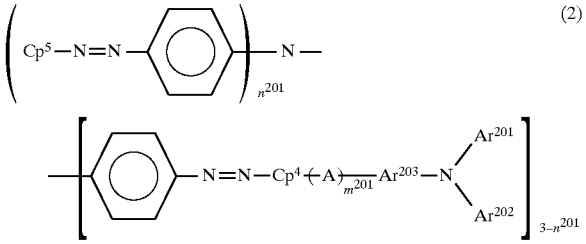

(2)

wherein $Cp^4$ is a bivalent coupler radical; $Cp^5$ is a monovalent coupler radical; $Ar^{201}$, $Ar^{202}$, $Ar^{203}$, A and $m^{201}$ are the same as those as previously defined in formula (1-a); and $n^{201}$ is an integer of 0 to 2.

In the above-mentioned formulas (1) and (2), specific examples of the aryl group represented by $Ar^{201}$ and $Ar^{202}$ are phenyl group, biphenylyl group, terphenylyl group, pentalenyl group, indenyl group, naphthyl group, azulenyl group, heptalenyl group, biphenylenyl group, as-indacenyl group, fluorenyl group, s-indacenyl group, acenaphthylenyl group, pleiadenyl group, acenaphthenyl group, phenalenyl group, phenanthryl group, anthryl group, fluoranthenyl group, acephenanthrylenyl group, aceanthrylenyl group, triphenylenyl group, pyrenyl group, chrysenyl group, naphthacenyl group, styrylphenyl group, pyridyl group, pyrimidyl group, pyrazinyl group, triazinyl group, furyl group, pyrrolyl group, thienyl group, quinolyl group, coumarinyl group, benzofuranyl group, benzimidazolyl group, benzoxazolyl group, dibenzofuranyl group, benzothienyl group, dibenzothionyl group, indolyl group, carbazolyl group, pyrazolyl group, imidazolyl group, oxazolyl group, isooxazolyl group, thiazolyl group, indazolyl group, benzothiazolyl group, pyridazinyl group, cinnolinyl group, quinazolinyl group, quinoxalyl group, phthalazinyl group, phthalazinedionyl group, chromonyl group, naphtholactonyl group, quinolonyl group, o-sulfobenzoic acid imidyl group, maleic acid imidyl group, naphthalidinyl group, benzimidazolonyl group, benzoxazolonyl group, benzothiazolonyl group, benzothiazothionyl group, quinazolonyl group, quinoxalonyl group, phthalazonyl group, dioxopyridinyl group, pyridonyl group, isoquinolonyl group, isoquinolyl group, isothiazolyl group, benzisooxazolyl group, benzisothiazolyl group, indazolonyl group, acridinyl group, acridonyl group, quinazolinedionyl group, quinoxalinedionyl group, benzoxazinedionyl group, benzoxazinyl group and naphthalimidyl group.

The arylene group represented by $Ar^{203}$ in the formulas (1) and (2) represents a bivalent group derived from the above-mentioned aryl group. Specific examples of the arylene group include phenylene group, biphenylene group, pyrenylene group, N-ethylcarbazolylene group and stilbene group.

Specific examples of the substituent for the aryl group and arylene group represented by $Ar^{201}$, $Ar^{202}$ and $Ar^{203}$ include an alkyl group such as methyl group, ethyl group, propyl group or butyl group; an alkoxyl group such as methoxy group, ethoxy group, propoxy group or butoxy group; nitro group; a halogen atom such as chlorine atom or bromine atom; cyano group; a dialkylamino group such as dimethylamino group or diethylamino group; a styryl group such as β-phenylstyryl group; and the aryl group as previously defined.

Examples of the coupler radicals represented by $Cp^1$, $Cp^2$, $Cp^3$, $Cp^4$ and $Cp^5$ for use in the azo compounds of formulas (1) and (2) include radicals derived from an aromatic hydrocarbon compound having hydroxyl group and a heterocyclic compound having hydroxyl group, such as phenols and naphthols; an aromatic hydrocarbon compound having amino group and a heterocyclic compound having amino group; an aromatic hydrocarbon compound having hydroxyl group and amino group and a heterocyclic compound having hydroxyl group and amino group, such as aminonaphthols; and an aliphatic or aromatic compound having a ketone group of phenol form, that is, a compound with an active methylene group.

Examples of the monovalent coupler radical represented by $Cp^1$, $Cp^2$ or $Cp^5$ are the following radicals (A) to (N):

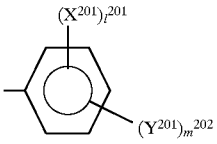

(A)

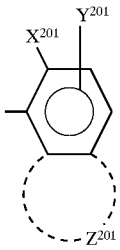

(B)

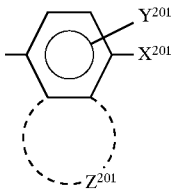

(C)

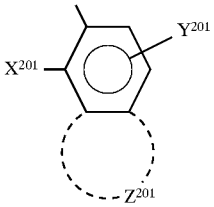

(D)

wherein:

$X^{201}$ is —OH, —N($R^{201}$) ($R^{202}$), or —$NHSO_4$—$R^{203}$, in which $R^{201}$ and $R^{202}$ are each hydrogen atom, or a substituted or unsubstituted alkyl group; and $R^{203}$ is a substituted or unsubstituted alkyl group, or a substituted or unsubstituted aryl group;

$Y^{201}$ is hydrogen atom, a halogen atom, a substituted or unsubstituted alkyl group, a substituted or unsubstituted alkoxyl group, carboxyl group, sulfone group, a substituted or unsubstituted sulfamoyl group, —CON($R^{204}$)($Y^{202}$) or —CONHCON($R^{204}$)($Y^{202}$), in which $R^{204}$ is hydrogen atom, a substituted or unsubstituted alkyl group, or a substituted or unsubstituted phenyl group; and $Y^{202}$ is a substituted or unsubstituted cyclic hydrocarbon group, a substituted or unsubstituted heterocyclic group, or —N=C($R^{205}$)($R^{206}$), in which $R^{205}$ is a substituted or unsubstituted cyclic hydrocarbon group, a substituted or unsubstituted heterocyclic group, or substituted or unsubstituted styryl group; and $R^{206}$ is hydrogen atom, a substituted or unsubstituted alkyl group, or a substituted or unsubstituted phenyl group, and $R^{205}$ and $R^{206}$ may form a ring together with the carbon atom bonded thereto;

$Z^{201}$ is an atomic group which constitutes a substituted or unsubstituted aromatic hydrocarbon ring, or a substituted or unsubstituted aromatic heterocyclic ring;

$l^{201}$ is an integer of 1 or 2; and $m^{202}$ is an integer of 1 or 2.

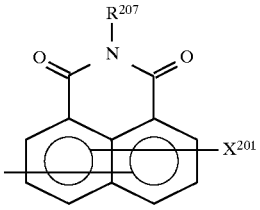

(E)

wherein $R^{207}$ is a substituted or unsubstituted hydrocarbon group; and $X^{201}$ is the same as that previously defined.

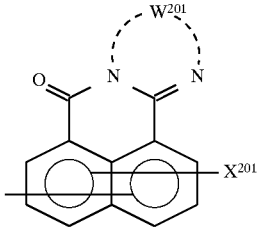

(F)

wherein $W^{201}$ is a bivalent aromatic hydrocarbon group or a bivalent heterocyclic group containing nitrogen atom therein, and the ring may have a substituent; and $X^{201}$ is the same as that previously defined.

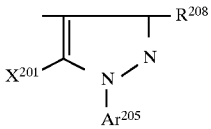

(G)

wherein $R^{208}$ is an alkyl group, carbamoyl group, or carboxyl group or an ester group thereof; $Ar^{205}$ is a substituted or unsubstituted cyclic hydrocarbon group; and $X^{201}$ is the same as that previously defined.

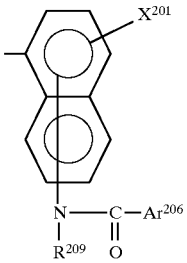

(H)

-continued

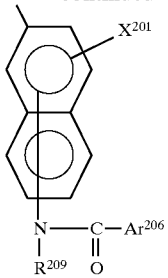

(J)

wherein $R^{209}$ is hydrogen atom, or a substituted or unsubstituted hydrocarbon group; and $Ar^{206}$ is a substituted or unsubstituted cyclic hydrocarbon group.

In the previously mentioned formulas (B), (C) and (D), $Z^{201}$ represents a hydrocarbon ring such as benzene ring or naphthalene ring; or a heterocyclic ring such as indole ring, carbazole ring, benzofuran ring or dibenzofuran ring. The ring represented by $Z^{201}$ may have as a substituent a halogen atom, such as chlorine or bromine.

Specific examples of the cyclic hydrocarbon group represented by $Y^{202}$ or $R^{205}$ include phenyl group, naphthyl group, anthryl group, and pyrenyl group; and specific examples of the heterocyclic group represented by $Y^{202}$ or $R^{205}$ include pyridyl group, thienyl group, furyl group, indolyl group, benzofuranyl group, carbazolyl group, and dibenzofuranyl group. Further, $R^{205}$ and $R^{206}$ may form in combination a ring such as fluorene ring. Specific examples of the substituent for the cyclic hydrocarbon group or heterocyclic group represented by $Y^{202}$ or $R^{205}$, or the substituent for the ring formed by the combination of $R^{205}$ and $R^{206}$ include an alkyl group such as methyl group, ethyl group, propyl group or butyl group; an alkoxyl group such as methoxy group, ethoxy group, propoxy group or butoxy group; a halogen atom such as chlorine atom or bromine atom; a dialkylamino group such as dimethylamino group or diethylamino group; a halomethyl group such as trifluoromethyl group; nitro group; cyano group; carboxyl group and an ester group thereof; hydroxyl group; and a sulfonate group such as $—SO_3Na$.

As a substituent for the phenyl group represented by $R^{204}$, there can be employed a halogen atom such as chlorine atom or bromine atom.

As the hydrocarbon group represented by $R^{207}$ or $R^{209}$ in the formulas (E), (H) and (J), there can be employed:

an alkyl group such as methyl group, ethyl group, propyl group or butyl group, which may have a substituent selected from the group consisting of an alkoxyl group such as methoxy group, ethoxy group, propoxy group or butoxy group, a halogen atom such as chlorine atom or bromine atom, hydroxyl group and nitro group; and an aryl group such as phenyl group, which may have a substituent selected from the group consisting of an alkyl group such as methyl group, ethyl group, propyl group or butyl group; an alkoxyl group such as methoxy group, ethoxy group, propoxy group or butoxy group, a halogen atom such as chlorine atom or bromine atom, hydroxyl group and nitro group.

Examples of the cyclic hydrocarbon group represented by $Ar^{205}$ or $Ar^{206}$ in formulas (G), (H) and (J) are phenyl group and naphthyl group. Examples of the substituent for the cyclic hydrocarbon group represented by $Ar^{205}$ or $Ar^{206}$ are an alkyl group such as methyl group, ethyl group, propyl group or butyl group; an alkoxyl group such as methoxy group, ethoxy group, propoxy group or butoxy group; a halogen atom such as chlorine atom or bromine atom; cyano group; and a dialkylamino group such as dimethylamino group or diethylamino group.

In the coupler radicals (A) to (J), hydroxyl group is particularly preferable as $X^{201}$.

Of the above-mentioned coupler radicals the coupler radicals of formulas (B), (E), (F), (G), (H) and (J) are preferable in the present invention, and in particular, those coupler radicals of which $X^{201}$ represents hydroxyl group are more preferable.

To be more specific, the following coupler radical of formula (K) is preferable, and that of formula (L) is more preferable:

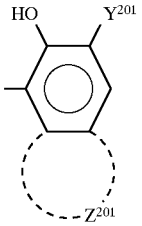

(K)

wherein $Y^{201}$ and $Z^{201}$ are the same as those previously defined.

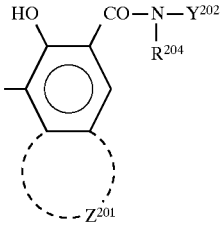

(L)

wherein $Z^{201}$, $Y^{202}$, and $R^{204}$ are the same as those previously defined.

Furthermore, the following coupler radical of formula (M) or (N) is particularly preferable:

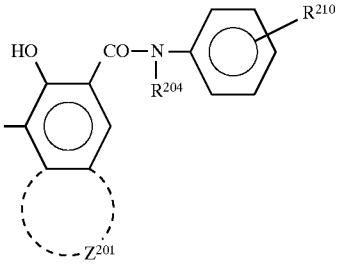

(M)

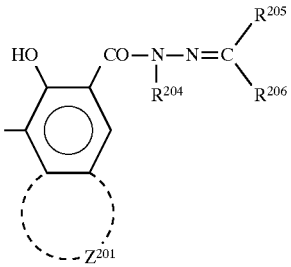

(N)

wherein $Z^{201}$, $R^{204}$, $R^{205}$ and $R^{206}$ are the same as those previously defined; and $R^{210}$ represents the same substituents as those $Y^{202}$.

The bivalent coupler radical —$Cp^3$— in formula (1-a) or —$Cp^4$— in formula (2) is derived from the aforementioned monovalent radicals of formulas (A) to (N). Further, the following bivalent coupler radicals of formulas (P) and (Q) are preferably employed for —$Cp^3$— or —$Cp^4$—:

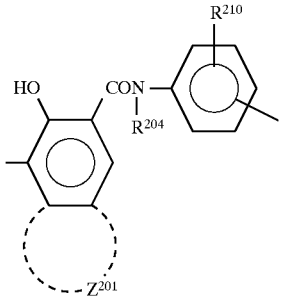

(P)

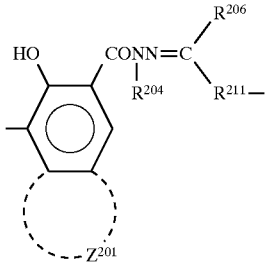

(Q)

wherein $Z^{201}$, $R^{204}$ and $R^{206}$ are the same as those previously defined; $R^{210}$ represents the same substituents as those for $Y^{202}$; and $R^{211}$ represents a bivalent group derived from any of the previously mentioned groups represented by $R^{205}$.

Specific examples of the coupler which is used for the azo compounds of formulas (1) and (2) for use in the present invention are shown in TABLES 1 to 14.

TABLE 1

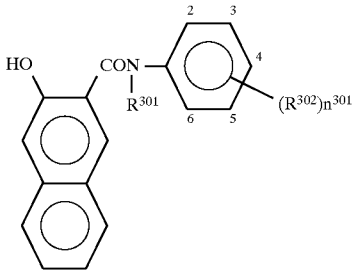

| Coupler No. | $R^{301}$ | $(R^{302})n^{301}$ |
|---|---|---|
| 1 | H | H |
| 2 | H | 2-$NO_2$ |
| 3 | H | 3-$NO_2$ |
| 4 | H | 4-$NO_2$ |
| 5 | H | 2-$CF_3$ |
| 6 | H | 3-$CF_3$ |
| 7 | H | 4-$CF_3$ |
| 8 | H | 2-CN |
| 9 | H | 3-CN |
| 10 | H | 4-CN |
| 11 | H | 2-I |
| 12 | H | 3-I |
| 13 | H | 4-I |
| 14 | H | 2-Br |
| 15 | H | 3-Br |
| 16 | H | 4-Br |
| 17 | H | 2-Cl |
| 18 | H | 3-Cl |
| 19 | H | 4-Cl |
| 20 | H | 2-F |
| 21 | H | 3-F |

TABLE 1-continued

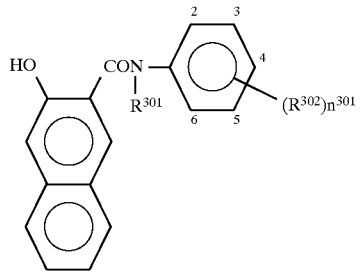

| Coupler No. | $R^{301}$ | $(R^{302})n^{301}$ |
|---|---|---|
| 22 | H | 4-F |
| 23 | H | 2-$CH_3$ |
| 24 | H | 3-$CH_3$ |
| 25 | H | 4-$CH_3$ |
| 26 | H | 2-$C_2H_5$ |
| 27 | H | 4-$C_2H_5$ |
| 28 | H | 2-$OCH_3$ |
| 29 | H | 3-$OCH_3$ |
| 30 | H | 4-$OCH_3$ |
| 31 | H | 2-$OC_2H_5$ |
| 32 | H | 3-$OC_2H_5$ |
| 33 | H | 4-$OC_2H_5$ |
| 34 | H | 4-$N(CH_3)_2$ |
| 35 | $-CH_3$ | H |
| 36 | 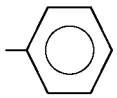 | H |
| 37 | H | 2-$OCH_3$, 5-$OCH_3$ |
| 38 | H | 2-$OC_2H_5$, 5-$OC_2H_5$ |
| 39 | H | 2-$CH_3$, 5-$CH_3$ |
| 40 | H | 2-Cl, 5-Cl |
| 41 | H | 2-$CH_3$, 5-Cl |
| 42 | H | 2-$OCH_3$, 4-$OCH_3$ |
| 43 | H | 2-$CH_3$, 4-$CH_3$ |
| 44 | H | 2-$CH_3$, 4-Cl |
| 45 | H | 2-$NO_2$, 4-$OCH_3$ |
| 46 | H | 3-$OCH_3$, 5-$OCH_3$ |
| 47 | H | 2-$OCH_3$, 5-Cl |
| 48 | H | 2-$OCH_3$, 5-$OCH_3$, 4-Cl |
| 49 | H | 2-$OCH_3$, 4-$OCH_3$, 5-Cl |
| 50 | H | 3-Cl, 4-Cl |
| 51 | H | 2-Cl, 4-Cl, 5-Cl |
| 52 | H | 2-$CH_3$, 3-Cl |
| 53 | H | 3-Cl, 4-$CH_3$ |
| 54 | H | 2-F, 4-F |
| 55 | H | 2-F, 5-F |
| 56 | H | 2-Cl, 4-$NO_2$ |
| 57 | H | 2-$NO_2$, 4-Cl |
| 58 | H | 2-Cl, 3-Cl, 4-Cl, 5-Cl |
| 59 | H | 4-OH |

TABLE 2

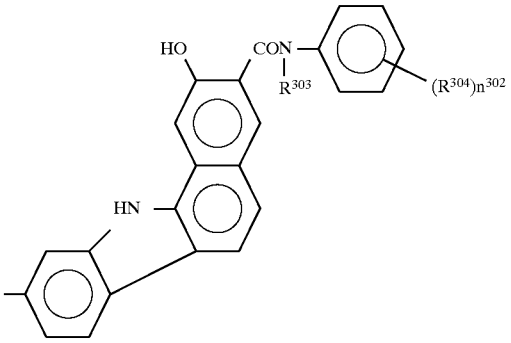

| Coupler No. | $R^{303}$ | $(R^{304})n^{302}$ |
|---|---|---|
| 60 | H | H |
| 61 | H | 2-$NO_2$ |
| 62 | H | 3-$NO_2$ |
| 63 | H | 4-$NO_2$ |
| 64 | H | 2-Cl |
| 65 | H | 3-Cl |
| 66 | H | 4-Cl |
| 67 | H | 2-$CH_3$ |
| 68 | H | 3-$CH_3$ |
| 69 | H | 4-$CH_3$ |
| 70 | H | 2-$C_2H_5$ |
| 71 | H | 4-$C_2H_5$ |
| 72 | H | 2-$OCH_3$ |
| 73 | H | 3-$OCH_3$ |
| 74 | H | 4-$OCH_3$ |
| 75 | H | 2-$OC_2H_5$ |
| 76 | H | 4-$OC_2H_5$ |
| 77 | H | 2-$CH_3$, 4-$OCH_3$ |
| 78 | H | 2-$CH_3$, 4-$CH_3$ |
| 79 | H | 2-$CH_3$, 5-$CH_3$ |
| 80 | H | 2-$CH_3$, 6-$CH_3$ |
| 81 | H | 2-$OCH_3$, 4-$OCH_3$ |
| 82 | H | 2-$OCH_3$, 5-$OCH_3$ |
| 83 | H | 3-$OCH_3$, 5-$OCH_3$ |
| 84 | H | 2-$CH_3$, 3-Cl |
| 85 | H | 2-$CH_3$, 4-Cl |
| 86 | H | 2-$CH_3$, 5-Cl |
| 87 | H | 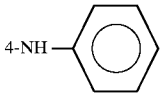 |
| 88 | H | 2-$CH(CH_3)_2$ |

TABLE 3

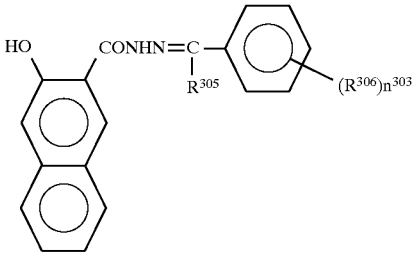

| Coupler No. | $R^{305}$ | $(R^{306})n^{303}$ |
|---|---|---|
| 89 | H | H |
| 90 | H | 4-$N(CH_3)_2$ |
| 91 | H | 2-$OCH_3$ |
| 92 | H | 3-$OCH_3$ |
| 93 | H | 4-$OCH_3$ |

TABLE 3-continued
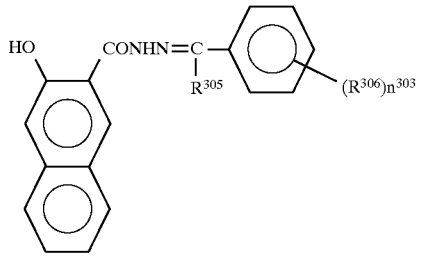
| Coupler No. | $R^{305}$ | $(R^{306})n^{303}$ |
|---|---|---|
| 94 | H | 4-$C_2H_5$ |
| 95 | H | 2-$CH_3$ |
| 96 | H | 3-$CH_3$ |
| 97 | H | 4-$CH_3$ |
| 98 | H | 2-F |
| 99 | H | 3-F |
| 100 | H | 4-F |
| 101 | H | 2-Cl |
| 102 | H | 3-Cl |
| 103 | H | 4-Cl |
| 104 | H | 2-Br |
| 105 | H | 3-Br |
| 106 | H | 4-Br |
| 107 | H | 2-Cl, 4-Cl |
| 108 | H | 3-Cl, 4-Cl |
| 109 | H | 2-CN |
| 110 | H | 4-CN |
| 111 | H | 2-$NO_2$ |
| 112 | H | 3-$NO_2$ |
| 113 | H | 4-$NO_2$ |
| 114 | H | 2-$CH_3$, 4-$CH_3$ |
| 115 | | 2-$OCH_3$, 5-$OCH_3$ |
| 116 | H | 2-$OCH_3$, 3-$OCH_3$, 4-$OCH_3$ |
| 117 | $-CH_3$ | H |
| 118 | 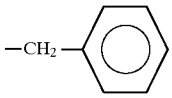 | H |
| 119 | 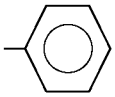 | H |
| 120 | H | 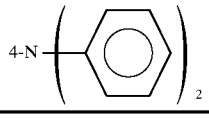 |
TABLE 4
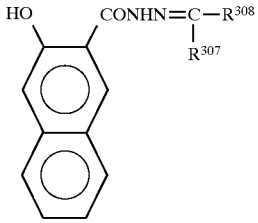
| Coupler No. | $R^{307}$ | $R^{308}$ |
|---|---|---|
| 121 | $-CH_3$ | $-CH_3$ |
TABLE 4-continued
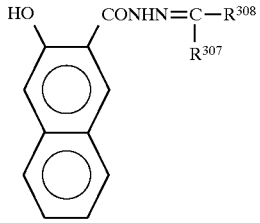
| Coupler No. | $R^{307}$ | $R^{308}$ |
|---|---|---|
| 122 | H | 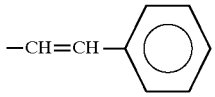 |
| 123 | H | 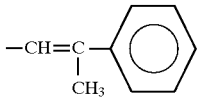 |
| 124 | H | 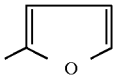 |
| 125 | H | 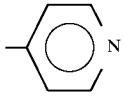 |
| 126 | H | 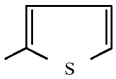 |
| 127 | $-CH_3$ | 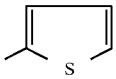 |
| 128 | H | 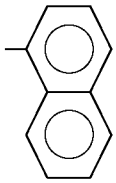 |
| 129 | H | 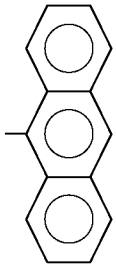 |
| 130 | H | 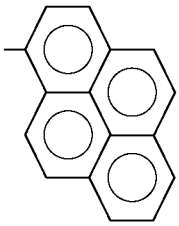 |

TABLE 4-continued
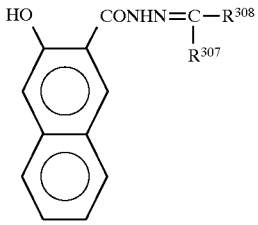
| Coupler No. | $R^{307}$ | $R^{308}$ |
|---|---|---|
| 131 | H | 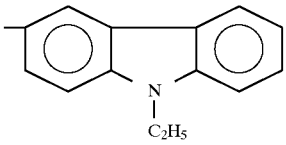 |
| 132 | H | 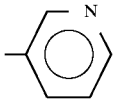 |
TABLE 5
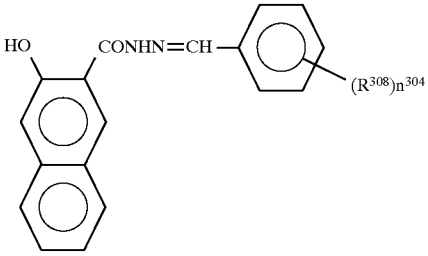
| Coupler No. | $(R^{309})n^{304}$ |
|---|---|
| 133 | H |
| 134 | 2-$OCH_3$ |
| 135 | 3-$OCH_3$ |
| 136 | 4-$OCH_3$ |
| 137 | 2-$CH_3$ |
| 138 | 3-$CH_3$ |
| 139 | 4-$CH_3$ |
| 140 | 4-Cl |
| 141 | 2-$NO_2$ |
| 142 | 4-$NO_2$ |
| 143 | 2-OH |
| 144 | 2-OH, 3-$NO_2$ |
| 145 | 2-OH, 5-$NO_2$ |
| 146 | 2-OH, 3-$OCH_3$ |
TABLE 6
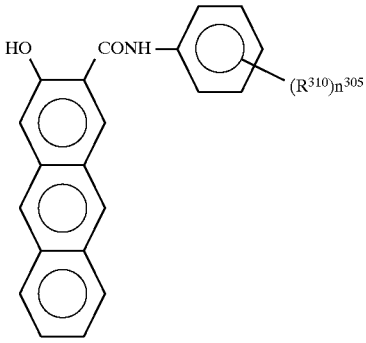
| Coupler No. | $(R^{310})n^{305}$ |
|---|---|
| 147 | 4-Cl |
| 148 | 2-$NO_2$ |
| 149 | 3-$NO_2$ |
| 150 | 4-$NO_2$ |
| 151 | 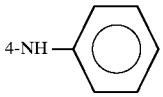 |
| 152 | H |
| 153 | 2-$OCH_3$ |
| 154 | 3-$OCH_3$ |
| 155 | 4-$OCH_3$ |
| 156 | 2-$CH_3$ |
| 157 | 3-$CH_3$ |
| 158 | 4-$CH_3$ |
| 159 | 2-Cl |
| 160 | 3-Cl |
TABLE 7
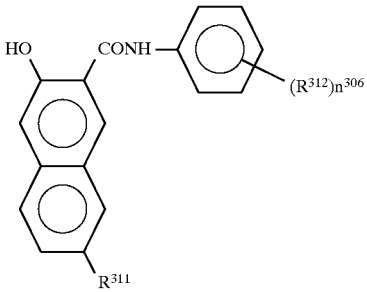
| Coupler No. | $R^{311}$ | $(R^{312})n^{306}$ |
|---|---|---|
| 161 | H | 2-$OCH_3$, 4-Cl, 5-$CH_3$ |
| 162 | —$OCH_3$ | H |
| 163 | —$OCH_3$ | 2-$CH_3$ |
| 164 | —$OCH_3$ | 2-$OCH_3$, 5-$OCH_3$, 4-Cl |

TABLE 8
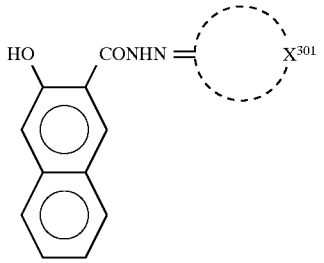
| Coupler No. | $X^{301}$ |
|---|---|
| 165 | 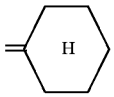 |
| 166 | 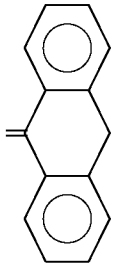 |
| 167 | 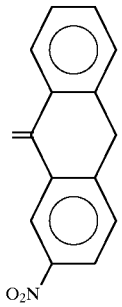 |
TABLE 9
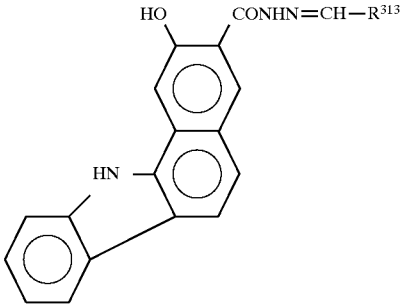
| Coupler No. | $R^{313}$ |
|---|---|
| 168 | 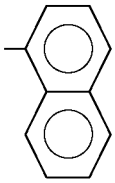 |
TABLE 9-continued
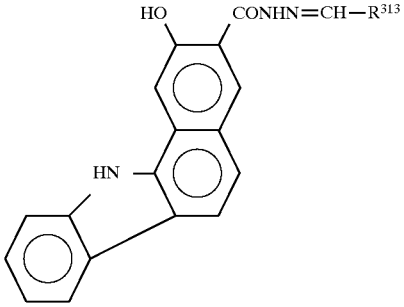
| Coupler No. | $R^{313}$ |
|---|---|
| 169 | 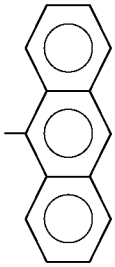 |
| 170 | 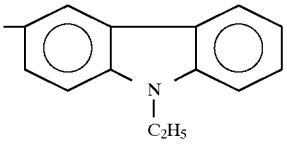  |
| 171 | 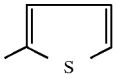  |
TABLE 10
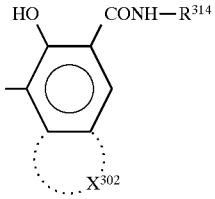
| Coupler No. | $X^{302}$ | $R^{314}$ |
|---|---|---|
| 172 | 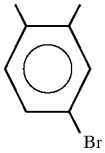  | 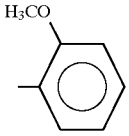  |
| 173 | 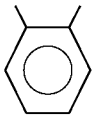 | 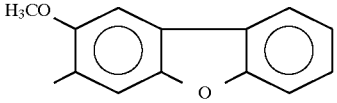  |

TABLE 10-continued
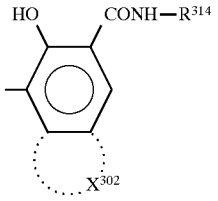
| Coupler No. | $X^{302}$ | $R^{314}$ |
|---|---|---|
| 174 | 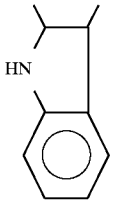 | 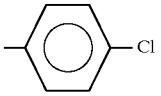 |
| 175 | 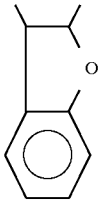 | 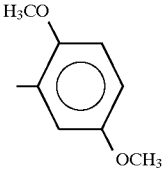 |
| 176 | 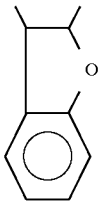 | 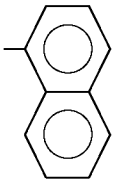 |
| 177 | 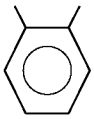 | 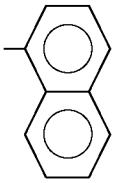 |
TABLE 11
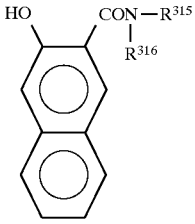
| Coupler No. | $R^{315}$ | $R^{316}$ |
|---|---|---|
| 178 | H | H |
| 179 | $-CH_3$ | H |
| 180 | $-CH_3$ | $-CH_3$ |
TABLE 11-continued
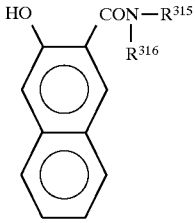
| | | |
|---|---|---|
| 181 | H | 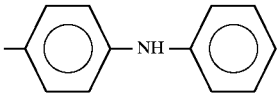 |
| Coupler No. | Structure |
|---|---|
| 182 | 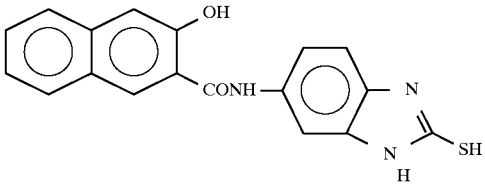 |
| 183 | 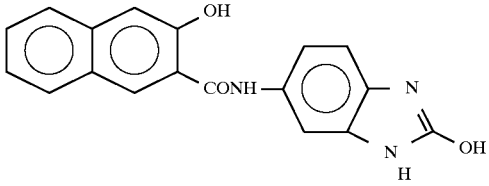 |
| 184 | 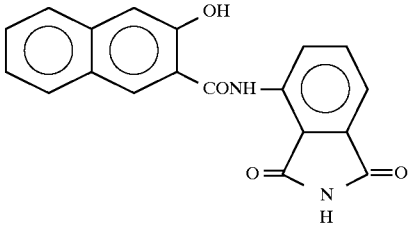 |
| 185 | 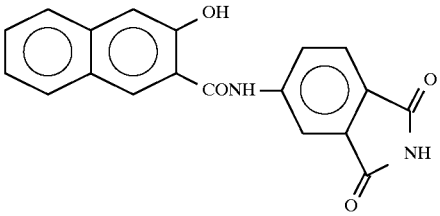 |
| 186 | 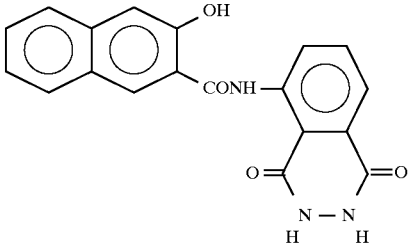 |

TABLE 11-continued
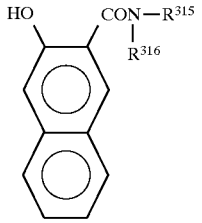
187
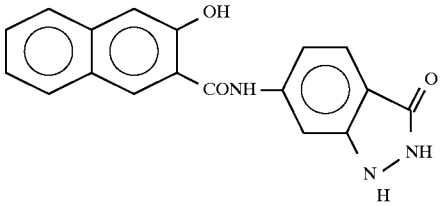
188
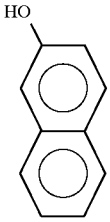
189
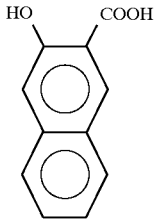
190
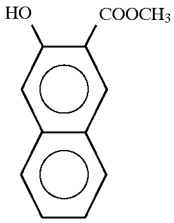
191
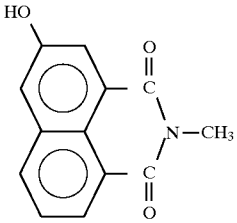
192
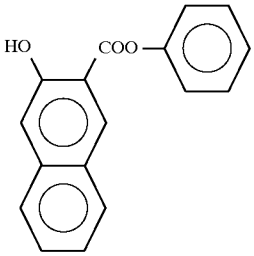
TABLE 11-continued
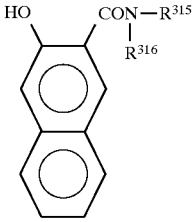
193
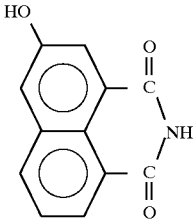
194
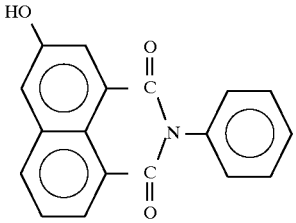
195
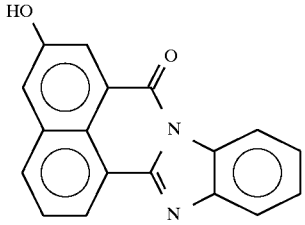
196
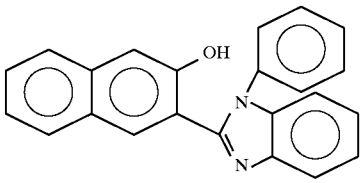
197
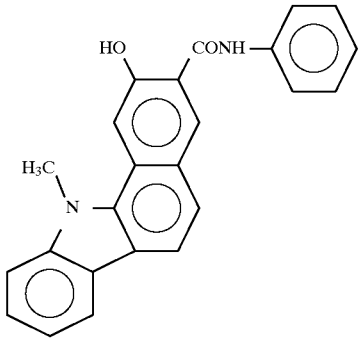

TABLE 11-continued

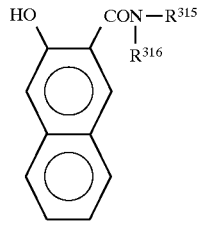

198

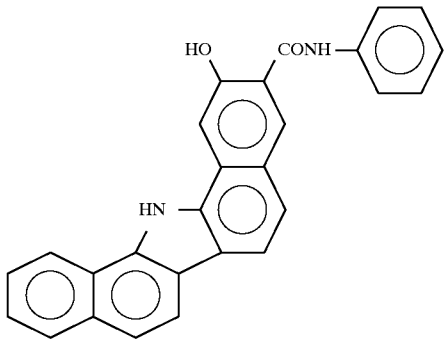

199

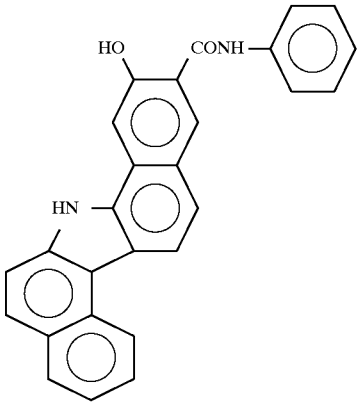

200

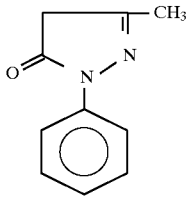

TABLE 12

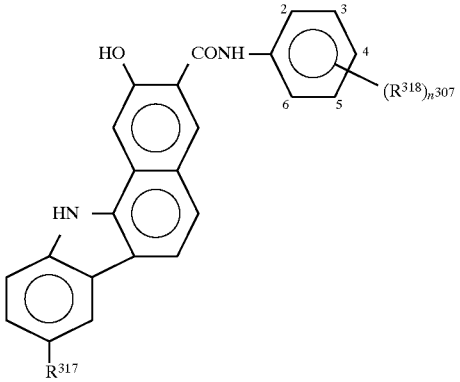

| Coupler No. | $R^{317}$ | $(R^{318})n^{307}$ |
|---|---|---|
| 201 | Cl | H |
| 202 | Cl | 2-$OCH_3$ |
| 203 | Cl | 3-$OCH_3$ |
| 204 | Cl | 4-$OCH_3$ |
| 205 | Cl | 2-$CH_3$ |
| 206 | Cl | 3-$CH_3$ |
| 207 | Cl | 4-$CH_3$ |
| 208 | Cl | 2-Cl |
| 209 | Cl | 3-Cl |
| 210 | Cl | 4-Cl |
| 211 | Cl | 2-$NO_2$ |
| 212 | Cl | 3-$NO_2$ |
| 213 | Cl | 4-$NO_2$ |
| 214 | Cl | 2-$CH_3$, 4-Cl |
| 215 | Cl | 2-$CH_3$, 4-$CH_3$ |
| 216 | Cl | 2-$C_2H_5$ |
| 217 | $CH_3$ | H |
| 218 | $CH_3$ | 2-$OCH_3$ |
| 219 | $CH_3$ | 3-$OCH_3$ |
| 220 | $CH_3$ | 4-$OCH_3$ |
| 221 | $CH_3$ | 2-$CH_3$ |
| 222 | $CH_3$ | 3-$CH_3$ |
| 223 | $CH_3$ | 4-$CH_3$ |
| 224 | $CH_3$ | 2-Cl |
| 225 | $CH_3$ | 3-Cl |
| 226 | $CH_3$ | 4-Cl |
| 227 | $CH_3$ | 2-$NO_2$ |
| 228 | $CH_3$ | 3-$NO_2$ |
| 229 | $CH_3$ | 4-$NO_2$ |
| 230 | $CH_3$ | 2-$CH_3$, 4-Cl |
| 231 | $CH_3$ | 2-$CH_3$, 4-$CH_3$ |
| 232 | $CH_3$ | 2-$C_2H_5$ |
| 233 | $OCH_3$ | H |
| 234 | $OCH_3$ | 2-$OCH_3$ |
| 235 | $OCH_3$ | 3-$OCH_3$ |
| 236 | $OCH_3$ | 4-$OCH_3$ |
| 237 | $OCH_3$ | 2-$CH_3$ |
| 238 | $OCH_3$ | 3-$CH_3$ |
| 239 | $OCH_3$ | 4-$CH_3$ |
| 240 | $OCH_3$ | 2-Cl |
| 241 | $OCH_3$ | 3-Cl |
| 242 | $OCH_3$ | 4-Cl |
| 243 | $OCH_3$ | 2-$NO_2$ |
| 244 | $OCH_3$ | 3-$NO_2$ |
| 245 | $OCH_3$ | 4-$NO_2$ |
| 246 | $OCH_3$ | 2-$C_2H_5$ |

TABLE 12-continued
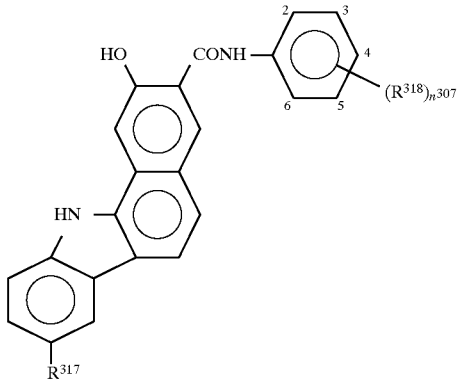
| Coupler No. | Structure |
|---|---|
| 247 | 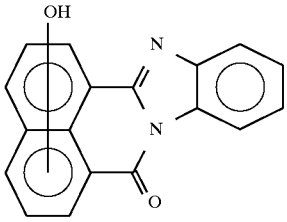 |
| 248 | 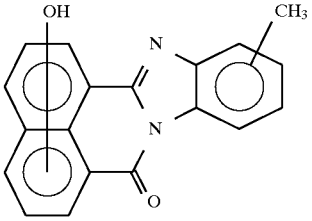 |
| 249 | 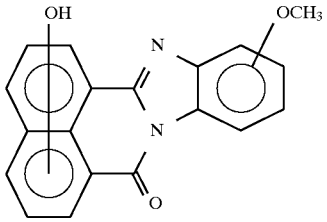 |
| 250 | 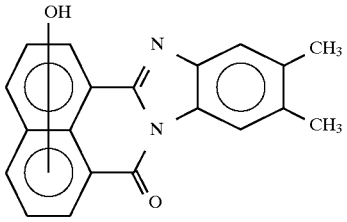 |
| 251 | 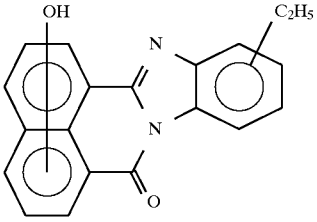 |
TABLE 12-continued
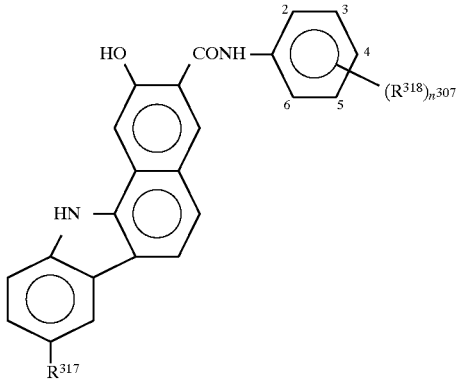
| | |
|---|---|
| 252 | 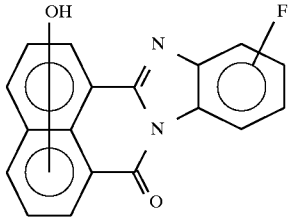 |
| 253 | 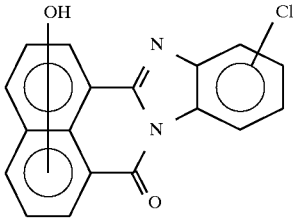 |
| 254 | 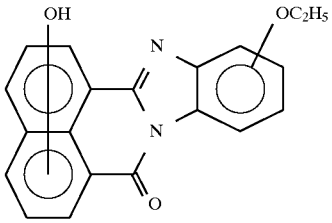 |
| 255 | 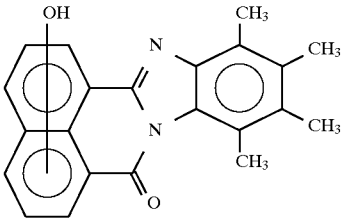 |
| 256 | 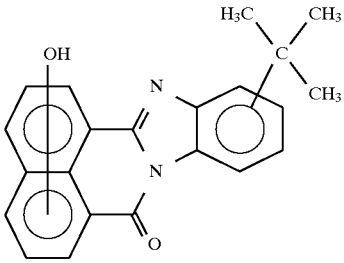 |

TABLE 12-continued

| | |
|---|---|
| 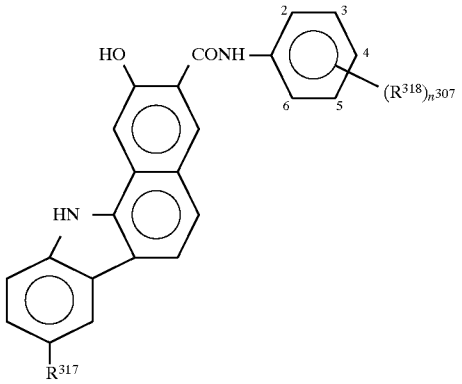 | |
| 257 | 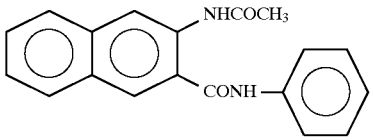 |
| 258 | 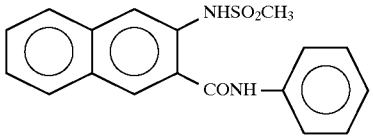 |

TABLE 13

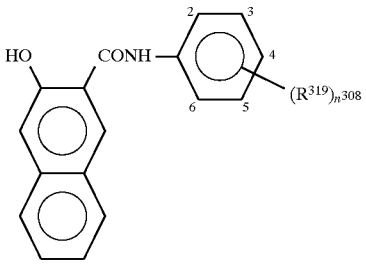

| Coupler No. | $(R^{319})n^{308}$ |
|---|---|
| 259 | 2-Cl, 3-Cl |
| 260 | 2-Cl, 4-Cl |
| 261 | 3-Cl, 5-Cl |

TABLE 14

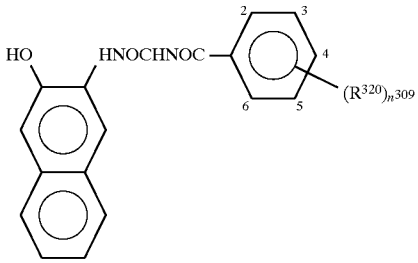

| Coupler No. | $(R^{320})n^{309}$ |
|---|---|
| 262 | 4-$CH_3$ |
| 263 | 3-$NO_2$ |

TABLE 14-continued

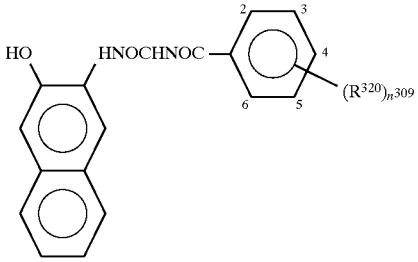

| Coupler No. | $(R^{320})n^{309}$ |
|---|---|
| 264 | 2-Cl |
| 265 | 3-Cl |
| 266 | 4-Cl |
| 267 | 2-Cl, 3-Cl |
| 268 | 2-Cl, 4-Cl |
| 269 | 3-Cl, 5-Cl |
| 270 | 2-Cl, 5-Cl |
| 271 | 3-Cl, 4-Cl |

The aforementioned azo compound represented by formula (1) or (2) may be used together with other conventional charge generation materials when necessary.

Specific examples of such conventional charge generation materials which can be used together with the azo compounds for use in the present invention are phthalocyanine pigments such as metallo-phthalocyanine and metal-free phthalocyanine, azulenium salt pigments, squaric acid methyne pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryl oxadiazole skeleton, azo pigments having a distyryl carbazole skeleton, perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoid pigments, and bisbenzimidazole pigments.

The charge generation layer 31 may further comprise a binder resin when necessary.

Examples of the binder resin for use in the charge generation layer 31 are polyamide, polyurethane, epoxy resin, polyketone, polycarbonate, silicone resin, acrylic resin, polyvinyl butyral, polyvinyl formal, polyvinyl ketone, polystyrene, poly-N-vinylcarbazole and polyacrylamide. Those binder resins may be used alone or in combination.

In addition to such binder resins, the previously mentioned polycarbonate resin serving as the high-molecular weight charge transport material can also be used as the binder resin in the charge generation layer 31.

Further, in the charge generation layer 31, a low-molecular weight charge transport material may be contained when necessary.

The low-molecular weight charge transport material for use in the charge generation layer 31 includes a positive hole transport material and an electron transport material.

Examples of the electron transport material are conventional electron acceptor compounds such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, and 1,3,7-trinitrodibenzothiophene-5,5-dioxide. Those electron transport materials may be used alone or in combination.

Examples of the positive hole transport material are electron donor compounds such as oxazole derivatives, oxadiazole derivatives, imidazole derivatives, triphenylamine derivatives, 9-(p-diethylaminostyryl anthracene), 1,1-bis-(4-dibenzylaminophenyl)propane, styryl anthracene, styryl pyrazoline, phenylhydrazone, α-phenylstilbene derivatives, thiazole derivatives, triazole derivatives, phenazine derivatives, acridine derivatives, benzofuran derivatives, benzimidazole derivatives, and thiophene derivatives. Those positive hole transport materials may be used alone or in combination.

When the charge generation layer 31 is formed by the casting method, the above-mentioned charge generation material is dispersed in a proper solvent such as tetrahydrofuran, cyclohexanone, dioxane, dichioroethane or butanone, optionally in combination with the binder resin, using a ball mill, an attritor or a sand mill. The dispersion thus obtained may appropriately be diluted to prepare a coating liquid for the charge generation layer 31. The coating liquid for the charge generation layer 31 may be coated by dip coating, spray coating or beads coating, and then dried.

The proper thickness of the charge generation layer 31 is in the range of about 0.01 to 5 μm, and preferably in the range of 0.05 to 2 μm.

In the photoconductor of FIG. 2, the charge transport layer 33 of the photoconductive layer 23' comprises a high-molecular weight charge transport material, with a binder resin being optionally added thereto.

The above-mentioned high-molecular weight charge transport material for use in the present invention comprises a polycarbonate compound having a triarylamine structure at least on the main chain or side chain thereof.

In particular, it is preferable to employ the following polycarbonate compounds of formulas (3) to (12) as the high-molecular weight charge transport materials in the charge transport layer 33.

The high-molecular weight polycarbonate of formula (3) will now be explained in detail.

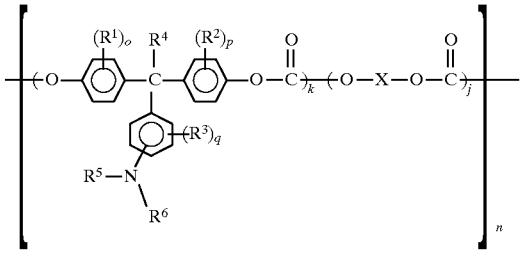

(3)

wherein $R^1$, $R^2$ and $R^3$ are each independently an alkyl group which may have a substituent or a halogen atom; $R^4$ is hydrogen atom or an alkyl group which may have a substituent; $R^5$ and $R^6$ are each independently an aryl group which may have a substituent; o, p and q are each independently an integer of 0 to 4; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

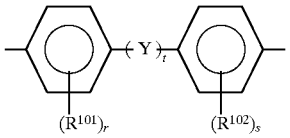

(3-a)

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

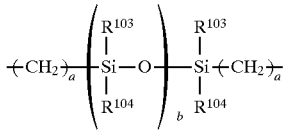

(3-b)

in which a is an integer of 1 to 20; b is an integer of 1 to 2,000; and $R^{103}$ and $R^{104}$, which may be the same or different, are each independently an alkyl group which may have a substituent or an aryl group which may have a substituent.

In the above-mentioned formula (3) it is preferable that the alkyl group represented by $R^1$, $R^2$ and $R^3$ be a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of the alkyl group represented by $R^1$, $R^2$ and $R^3$ are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4methoxybenzyl group, and 4-phenylbenzyl group.

Examples of the halogen atom represented by $R^1$, $R^2$ and $R^3$ include fluorine atom, chlorine atom, bromine atom and iodine atom.

Specific examples of the substituted or unsubstituted alkyl group represented by $R^4$ are the same as those represented by $R^1$, $R^2$ and $R^3$ as mentioned above.

Examples of the aryl group represented by $R^5$ and $R^6$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidenephenyl group, and 5H-dibenzo[a,d]cycloheptenylidenephenyl group;

(3) Non-condensed polycyclic groups such as biphenylyl group and terphenylyl group; and (4) Heterocyclic groups such as thienyl group, benzothienyl group, furyl group, benzofuranyl group and carbazolyl group.

The above-mentioned aryl group may have a substituent. Examples of such a substituent for $R^5$ and $R^6$ are as follows:

(1) A halogen atom, cyano group, and nitro group.

(2) An alkyl group. There can be employed the same examples as mentioned in the explanation of $R^1$, $R^2$ and $R^3$.

(3) An alkoxyl group (—$OR^{105}$) in which $R^{105}$ is the same alkyl group as previously defined in (2).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercap to group.

Specific examples of the substituted mercapto group and arylmercapto group include methylthio group, ethylthio group, phenylthio group, and p-methylphenylthio group.

(6) An alkyl-substituted amino group. The same alkyl group as defined in (2) can be employed.

Specific examples of the alkyl-substituted amino group are dimethylamino group, diethylamino group, N-methyl-N-propylamino group, and N,N-dibenzylamino group.

(7) An acyl group such as acetyl group, propionyl group, butyryl group, malonyl group and benzoyl group.

Furthermore, the above-mentioned high-molecular weight compound of formula (3) can be produced in such a manner that a diol compound having triarylamino group represented by the following formula (3') is subjected to polymerization by the phosgene method or ester interchange method using a diol compound of formula (100) in combination, so that X is introduced into the main chain of the obtained compound:

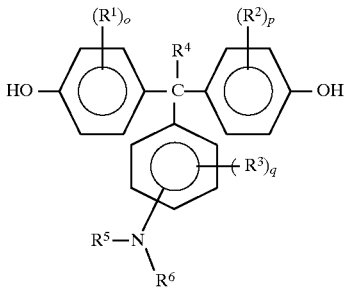

(3')

HO—X—OH (100)

wherein $R^1$ to $R^6$, o, p and q, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (3') and a bischloroformate derived from the diol compound of formula (100). In this case, the polycarbonate resin in the form of an alternating copolymer can be obtained.

Examples of the diol compound represented by formula (100) include aliphatic diols such as 1,3-propanediol, 1,4-butanediol, 1,5-pentanediol, 1,6-hexanediol, 1,8-octanediol, 1,10-decanediol, 2-methyl-1,3-propanediol, 2,2-dimethyl-1,3-propanediol, 2-ethyl-1,3-propanediol, diethylene glycol, triethylene glycol, polyethylene glycol and polytetramethylene ether glycol; and cyclic aliphatic diols such as 1,4-cyclohexanediol, 1,3-cyclohexanediol and cyclohexane-1,4-dimethanol.

Examples of the diol compound having an aromatic ring are as follows: 4,4'-dihydroxydiphenyl, bis(4-hydroxyphenyl)methane, 1,1-bis(4-hydroxyphenyl)ethane, 1,1-bis(4-hydroxyphenyl)-1-phenylethane, 2,2-bis(4-hydroxyphenyl)propane, 2,2-bis(3-methyl-4-hydroxyphenyl)-propane, 1,1-bis(4-hydroxyphenyl) cyclohexane, 1,1-bis(4-hydroxyphenyl)cyclopentane, 2,2-bis(3-phenyl-4-hydroxyphenyl)propane, 2,2-bis(3-isopropyl-4-hydroxyphenyl)propane, 2,2-bis(4-hydroxyphenyl)butane, 2,2-bis(3,5-dimethyl-4-hydroxyphenyl)propane, 2,2-bis(3,5-dibromo-4-hydroxyphenyl)propane, 4,4'-dihydroxydiphenylsulfone, 4,4'-dihydroxydiphenylsulfoxide, 4,4'-dihydroxydiphenylsulfide, 3,3'-dimethyl-4,4'-dihydroxydiphenylsulfide, 4,4'-dihydroxydiphenyloxide, 2,2-bis(4-hydroxyphenyl)hexafluoropropane, 9,9-bis(4-hydroxyphenyl)fluorene, 9,9-bis(4-hydroxyphenyl) xanthene, ethylene glycol-bis(4-hydroxybenzoate), diethylene glycol-bis(4-hydroxybenzoate), triethylene glycol-bis (4hydroxybenzoate), 1,3-bis(4-hydroxyphenyl)tetramethyl disiloxane, and phenol-modified silicone oil.

The polycarbonate of formula (4) preferably used as the high-molecular weight charge transport material is as follows:

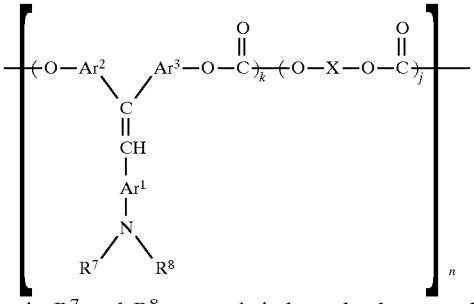

(4)

wherein $R^7$ and $R^8$ are each independently an aryl group which may have a substituent; $Ar^1$, $Ar^2$ and $Ar^3$, which may be the same or different, are each independently an arylene group; $0.1 \leqq k \leqq 1$; $0 \leqq j \leqq 0.9$; n is an integer of 5 to 5,000; and X is the same as that previously defined in formula (3).

Examples of the aryl group represented by $R^7$ and $R^8$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidenephenyl group, and 5H-dibenzo[a,d]cycloheptenylidenephenyl group;

(3) Non-condensed polycyclic groups such as biphenylyl group, terphenylyl group, and a group of the following formula:

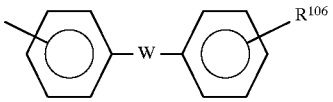

wherein W is —O—, —S—, —SO—, —$SO_2$—, —CO—, $$-(CH_2)_c-$$

in which c is an integer of 1 to 12, $$-(CH=CH)_d-$$

in which d is an integer of 1 to 3,

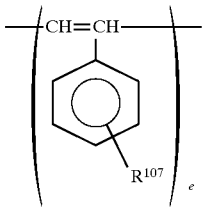

in which e is an integer of 1 to 3, or

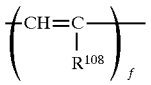

in which f is an integer of 1 to 3; and (4) Heterocyclic groups such as thienyl group, benzothienyl group, furyl group, benzofuranyl group and carbazolyl group.

As the arylene group represented by $Ar^1$, $Ar^2$ and $Ar^3$, there can be employed bivalent groups derived from the above-mentioned examples of the aryl group represented by $R^7$ and $R^8$.

The above-mentioned aryl group and arylene group may have a substituent. The above $R^{106}$, $R^{107}$ and $R^{108}$ also represent the same examples of the substituent to be listed below.

Examples of the substituent for $R^7$, $R^8$, $Ar^1$, $Ar^2$ and $Ar^3$ are as follows:

(1) A halogen atom, cyano group, and nitro group.

(2) An alkyl group, preferably a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(3) An alkoxyl group (—$OR^{109}$) in which $R^{109}$ is the same alkyl group as previously defined in (2).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercapto group.

Specific examples of the substituted mercapto group and arylmercapto group include methylthio group, ethylthio group, phenylthio group, and p-methylphenylthio group.

(6) An alkyl-substituted amino group represented by the following formula:

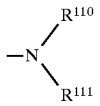

wherein $R^{110}$ and $R^{111}$ are each independently the same examples of the alkyl group as defined in (2) or an aryl group, such as phenyl group, biphenyl group, or naphthyl group.

This group may have a substituent such as an alkoxyl group having 1 to 4 carbon atoms, an alkyl group having 1 to 4 carbon atoms or a halogen atom. $R^{110}$ and $R^{111}$ may form a ring in combination with the carbon atoms of the aryl group.

Specific examples of the above-mentioned alkyl-substituted amino group are diethylamino group, N-methyl-N-phenylamino group, N,N-diphenylamino group, N,N-di(p-tolyl)amino group, dibenzylamino group, piperidino group, morpholino group and julolidyl group.

(7) An alkylenedioxy group such as methylenedioxy group, and an alkylenedithio group such as methylenedithio group.

Furthermore, the above-mentioned high-molecular weight compound of formula (4) can be produced in such a manner that a diol compound having triarylamino group represented by the following formula (4') is subjected to polymerization by the phosgene method or ester interchange method using a diol compound of formula (100) in combination, so that X is introduced into the main chain of the obtained compound:

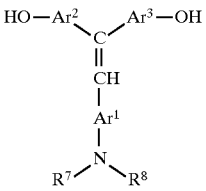

(4')

HO—X—OH (100)

wherein $Ar^1$ to $Ar^3$, $R^7$ and $R^8$ and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (4') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

The high-molecular/ weight compound of formula (5), that is, one of the polycarbonate resins preferably used in the photoconductive layer, will now be described in detail.

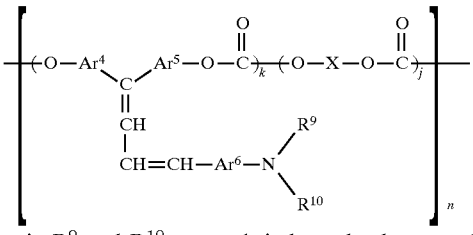

(5)

wherein $R^9$ and $R^{10}$ are each independently an aryl group which may have a substituent; $Ar^4$, $Ar^5$ and $Ar^6$, which may be the same or different, are each independently an arylene group; $0.1 \leqq k \leqq 1$; $0 \leqq j \leqq 0.9$; n is an integer of 5 to 5,000; and X is the same as that previously defined in formula (3).

Examples of the aryl group represented by $R^9$ and $R^{10}$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidenephenyl group, and 5H-dibenzo[a,d]cycloheptenylidenephenyl group;

(3) Non-condensed polycyclic groups such as biphenylyl group and terphenylyl group; and (4) Heterocyclic groups such as thienyl group, benzothienyl group, furyl group, benzofuranyl group and carbazolyl group.

As the arylene group represented by $Ar^4$, $Ar^5$ and $Ar^6$, there can be employed bivalent groups derived from the above-mentioned examples of the aryl group represented by $R^9$ and $R^{10}$.

The above-mentioned aryl group and arylene group may have a substituent.

Examples of such a substituent for $R^9$, $R^{10}$, $Ar^4$, $Ar^5$ and $Ar^6$ are as follows:

(1) A halogen atom, cyano group, and nitro group.

(2) An alkyl group, preferably a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(3) An alkoxyl group (—$OR^{112}$) in which $R^{112}$ is the same alkyl group as previously defined in (2).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercapto group.

Specific examples of the substituted mercapto group and arylmercapto group include methylthio group, ethylthio group, phenylthio group, and p-methylphenylthio group.

(6) An alkyl-substituted amino group. The same alkyl group as defined in (2) can be employed.

Specific examples of the alkyl-substituted amino group are dimethylamino group, diethylamino group, N-methyl-N-propylamino group, and N,N-dibenzylamino group.

(7) An acyl group such as acetyl group, propionyl group, butyryl group, malonyl group and benzoyl group.

Furthermore, the above-mentioned high-molecular weight compound of formula (5) can be produced in such a manner that a diol compound having triarylamino group represented by the following formula (5') is subjected to polymerization by the phosgene method or ester interchange method using a diol compound of formula (100) in combination, so that X is introduced into the main chain of the obtained compound:

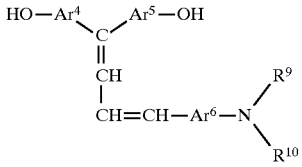

(5')

HO—X—OH (100)

wherein $R^9$ and $R^{10}$, $Ar^4$ to $Ar^6$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (5') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

The high-molecular weight compound of formula (6) will now be described in detail.

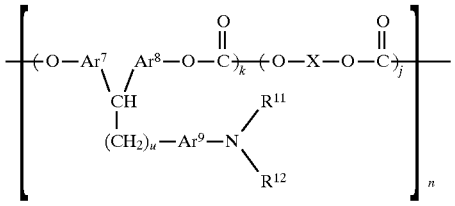

(6)

wherein $R^{11}$ and $R^{12}$ are each independently an aryl group which may have a substituent; $Ar^7$, $Ar^8$ and $Ar^9$, which may be the same or different, are each independently an arylene group; u is an integer of 1 to 5; $0.1 \leqq k \leqq 1$; $0 \leqq j \leqq 0.9$; n is an integer of 5 to 5,000; and X is the same as that previously defined in formula (3).

Examples of the aryl group represented by $R^{11}$ and $R^{12}$ are the same as those represented by $R^9$ and $R^{10}$ mentioned in the compound of formula (5).

As the arylene group represented by $Ar^7$, $Ar^8$ and $Ar^9$, there can be employed bivalent groups derived from the above-mentioned examples of the aryl group represented by $R^{11}$ and $R^{12}$.

The above-mentioned aryl group and arylene group may have a substituent.

The same substituents for the aryl group and arylene group as mentioned in the compound of formula (5) can be employed for $R^{11}$, $R^{12}$, $Ar^7$, $Ar^8$ and $Ar^9$.

Furthermore, the above-mentioned high-molecular weight compound of formula (6) can be produced in such a manner that a diol compound having triarylamino group represented by the following formula (6') is subjected to polymerization by the phosgene method or ester interchange method using a diol compound of formula (100) in combination, so that X is introduced into the main chain of the obtained compound:

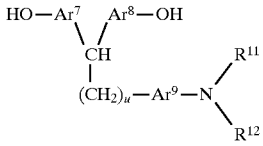

(6')

HO—X—OH (100)

wherein $R^{11}$ and $R^{12}$, $Ar^7$ to $Ar^9$, u, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (6') and a bischloroformate derived from the diol compound of formula (100). In this case, the polycarbonate resin in the form of an alternating copolymer can be obtained.

The same diol compounds as mentioned in formula (3) can also be employed as the dial compound of formula (100).

The high-molecular weight compound of formula (7) will now be described in detail.

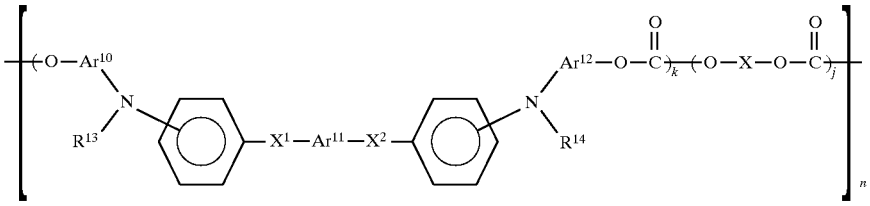

(7)

wherein $R^{13}$ and $R^{14}$ are each independently an aryl group which may have a substituent; $Ar^{10}$, $Ar^{11}$ and $Ar^{12}$, which may be the same or different, are each independently an arylene group; $X^1$ and $X^2$ are each independently ethylene group which may have a substituent or vinylene group which may have a substituent; $0.1 \leqq k \leqq 1$; $0 \leqq j \leqq 0.9$; n is an integer of 5 to 5,000; and X is the same as that previously defined in formula (3).

Examples of the aryl group represented by $R^{13}$ and $R^{14}$ are the same as those represented by $R^9$ and $R^{10}$ mentioned in the compound of formula (5).

As the arylene group represented by $Ar^{10}$, $Ar^{11}$ and $Ar^{12}$, there can be employed bivalent groups derived from the above-mentioned examples of the aryl group represented by $R^{13}$ and $R^{14}$.

The above-mentioned aryl group and arylene group may have a substituent.

The same substituents for the aryl group and arylene group as mentioned in the compound of formula (5) can be employed for $R^{13}$, $R^{14}$, $Ar^{10}$, $Ar^{11}$ and $Ar^{12}$.

Examples of the substituent for ethylene group or vinylene group represented by $X^1$ and $X^2$ include cyano group, a halogen atom, nitro group, the same aryl group as represented by $R^{13}$ and $R^{14}$, and the same alkyl group serving as the substituent for the aryl group or arylene group represented by $R^{13}$, $R^{14}$, $Ar^{10}$, $Ar^{11}$ and $Ar^{12}$.

Furthermore, the above-mentioned high-molecular weight compound of formula (7) can be produced in such a manner that a diol compound having triarylamino group represented by the following formula (7') is subjected to polymerization by the phosgene method or ester interchange method using a diol compound of formula (100) in combination, so that X is introduced into the main chain of the obtained compound:

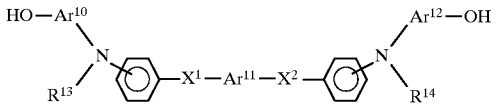

(7')

HO—X—OH (100)

wherein $R^{13}$ and $R^{14}$, $Ar^{10}$ to $Ar^{12}$, $X^1$ and $X^2$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (7') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

The high-molecular weight compound of formula (8) will now be described in detail.

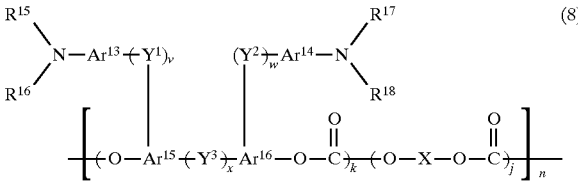

(8)

wherein $R^{15}$, $R^{16}$, $R^{17}$ and $R^{18}$ are each independently an aryl group which may have a substituent; $Ar^{13}$, $Ar^{14}$, $Ar^{15}$ and $Ar^{16}$, which may be the same or different, are each independently an arylene group; v, w and x are each independently an integer of 0 or 1, and when v, w and x are an integer of 1, $Y^1$, $Y^2$ and $Y^3$, which may be the same or different, are each independently an alkylene group which may have a substituent, a cycloalkylene group which may have a substituent, an alkylene ether group which may have a substituent, oxygen atom, sulfur atom, or vinylene group; $0.1 \leqq k \leqq 1$; $0 \leqq j \leqq 0.9$; n is an integer of 5 to 5,000; and X is the same as that previously defined in formula (3).

Examples of the aryl group represented by $R^{15}$ to $R^{18}$ are the same as those represented by $R^9$ and $R^{10}$ mentioned in the compound of formula (5).

As the arylene group represented by $Ar^{13}$ to $Ar^{16}$, there can be employed bivalent groups derived from the above-mentioned examples of the aryl group represented by $R^{15}$ to $R^{18}$.

The above-mentioned aryl group and arylene group may have a substituent, such as a halogen atom, cyano group, nitro group, an alkyl group, an alkoxyl group, and an aryloxy group. With respect to each of the above-mentioned substituents, the same examples as explained in the compound of formula (5) can be employed.

When $Y^1$ to $Y^3$ are each independently an alkylene group, there can be employed bivalent groups derived from the examples of the alkyl group as the substituent for the aryl group or arylene group represented by $R^{15}$ to $R^{18}$ and $Ar^{13}$ to $Ar^{16}$.

Specific examples of the alkylene group represented by $Y^1$ to $Y^3$ are methylene group, ethylene group, 1,3-propylene group, 1,4-butylene group, 2-methyl-1,3-propylene group, difluoromethylene group, hydroxyethylene group, cyanoethylene group, methoxyethylene group, phenylmethylene group, 4-methylphenylmethylene group, 2,2-propylene group, 2,2-butylene group and diphenylmethylene group.

Examples of the cycloalkylene group represented by $Y^1$ to $Y^3$ are 1,1-cyclopentylene group, 1,1-cyclohexylene group and 1,1-cyclooctylene group.

Examples of the alkylene ether group represented by $Y^1$ to $Y^3$ are dimethylene ether group, diethylene ether group, ethylene methylene ether group, bis(triethylene)ether group, and polytetramethylene ether group.

Furthermore, the above-mentioned high-molecular weight compound of formula (8) can be produced in such a manner that a diol compound having triarylamino group represented by the following formula (8') is subjected to polymerization by the phosgene method or ester interchange method using a diol compound of formula (100) in combination, so that X is introduced into the main chain of the obtained compound:

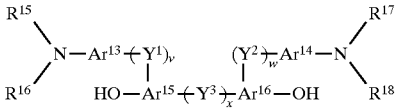

(8')

HO—X—OH (100)

wherein $R^{15}$ to $R^{18}$, $Ar^{13}$ to $Ar^{16}$, $Y^1$ to $Y^3$, v, w, x and X are the same as those previously defined.

In this case, the obtained polycarbonate resin is in the form of a random copolymer or block copolymer.

Alternatively, X can also be introduced into the repeat unit of the poly carbonate resin by the polymerization reaction of the dial compound of formula (8') and a bischloroformate derived from the diol compound of formula (100). In this case, the polycarbonate resin in the form of an alternating copolymer can be obtained.

The same dial compounds as mentioned in formula (3) can also be employed as the diol compound of formula (100).

The high-molecular weight compound of formula (9) will now be described in detail.

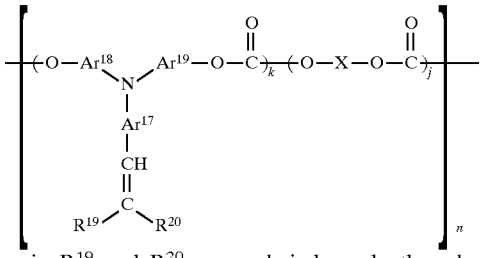

(9)

wherein $R^{19}$ and $R^{20}$ are each independently a hydrogen atom, or an aryl group which may have a substituent, and $R^{19}$ and $R^{20}$ may form a ring in combination; $Ar^{17}$, $Ar^{18}$ and $Ar^{19}$, which may be the same or different, are each independently an arylene group; $0.1 \leqq k \leqq 1$; $0 \leqq j \leqq 0.9$; n is an integer of 5 to 5,000; and X is the same as that previously defined in formula (3).

Examples of the aryl group represented by $R^{19}$ and $R^{20}$ are the same as those represented by $R^9$ and $R^{10}$ mentioned in the compound of formula (5). In addition, $R^{19}$ and $R^{20}$ may form a ring such as 9-fluorenylidene or 5H-dibenzo[a, d]cycloheptenylidene.

As the arylene group represented by $Ar^{17}$ to $Ar^{19}$, there can be employed bivalent groups derived from the above-mentioned examples of the aryl group represented by $R^{19}$ and $R^{20}$.

The above-mentioned aryl group and arylene group may have a substituent.

The same substituents for the aryl group and arylene group as mentioned in the compound of formula (5) can be employed for $R^{19}$ and $R^{20}$ and $Ar^{17}$ to $Ar^{19}$.

Furthermore, the above-mentioned high-molecular weight compound of formula (9) can be produced in such a manner that a diol compound having triarylamino group represented by the following formula (9') is subjected to polymerization by the phosgene method or ester interchange method using a diol compound of formula (100) in combination, so that X is introduced into the main chain of the obtained compound:

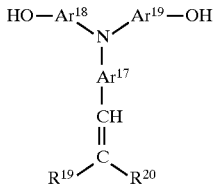

(9')

HO—X—OH (100)

wherein $R^{19}$ and $R^{20}$, $Ar^{17}$ to $Ar^{19}$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (9') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

The high-molecular weight compound of formula (10) will now be described in detail.

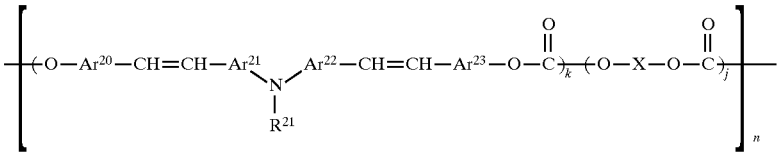

(10)

wherein $R^{21}$ is an aryl group which may have a substituent; $Ar^{20}$, $Ar^{21}$, $Ar^{22}$ and $Ar^{23}$, which may be the same or different, are each independently an arylene group; $0.1 \leqq k \leqq 1$; $0 \leqq j \leqq 0.9$; n is an integer of 5 to 5,000; and X is the same as that previously defined in formula (3).

Examples of the aryl group represented by $R^{21}$ are the same as those represented by $R^9$ and $R^{10}$ mentioned in the compound of formula (5).

As the arylene group represented by $Ar^{20}$ to $Ar^{23}$, there can be employed bivalent groups derived from the above-mentioned examples of the aryl group represented by $R^{21}$.

The above-mentioned aryl group and arylene group may have a substituent.

The same substituents for the aryl group and arylene group as mentioned in the compound of formula (5) can be employed for $R^{21}$ and $Ar^{20}$ to $Ar^{23}$.

Furthermore, the above-mentioned high-molecular weight compound of formula (10) can be produced in such a manner that a diol compound having triarylamino group represented by the following formula (10') is subjected to polymerization by the phosgene method or ester interchange method using a diol compound of formula (100) in combination, so that X is introduced into the main chain of the obtained compound:

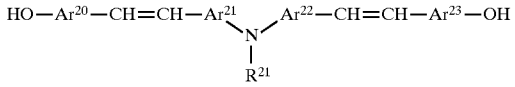

(10')

HO—X—OH (100)

wherein $R^{21}$, $Ar^{20}$ to $Ar^{23}$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (10') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

The high-molecular weight compound of formula (11) will now be described in detail.

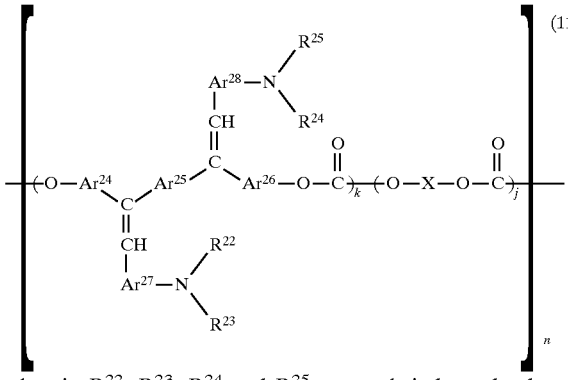

(11)

wherein $R^{22}$, $R^{23}$, $R^{24}$ and $R^{25}$ are each independently an aryl group which may have a substituent; $Ar^{24}$, $Ar^{25}$, $Ar^{26}$, $Ar^{27}$ and $Ar^{28}$, which may be the same or different, are each independently an arylene group; $0.1 \leqq k \leqq 1$; $0 \leqq j \leqq 0.9$; n is an integer of 5 to 5,000; and X is the same as that previously defined in formula (3).

Examples of the aryl group represented by $R^{22}$, $R^{23}$, $R^{24}$ and $R^{25}$ are the same as those represented by $R^9$ and $R^{10}$ mentioned in the compound of formula (5).

As the arylene group represented by $Ar^{24}$ to $Ar^{28}$, there can be employed bivalent groups derived from the above-mentioned examples of the aryl group represented by $R^{22}$ to $R^{25}$.

The above-mentioned aryl group and arylene group may have a substituent.

The same substituents for the aryl group and arylene group as mentioned in the compound of formula (5) can be employed for $R^{22}$ to $R^{25}$ and $Ar^{24}$ to $Ar^{28}$.

Furthermore, the above-mentioned high-molecular weight compound of formula (11) can be produced in such a manner that a diol compound having triarylamino group represented by the following formula (11') is subjected to polymerization by the phosgene method or ester interchange method using a diol compound of formula (100) in combination, so that X is introduced into the main chain of the obtained compound:

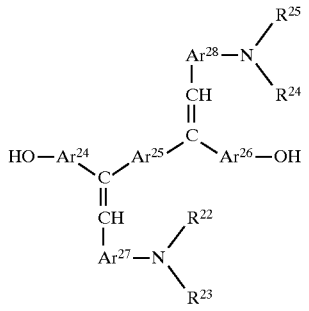

(11')

HO—X—OH (100)

wherein $R^{22}$ to $R^{25}$, $Ar^{24}$ to $Ar^{28}$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (11') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

The high-molecular weight compound of formula (12) will now be described in detail.

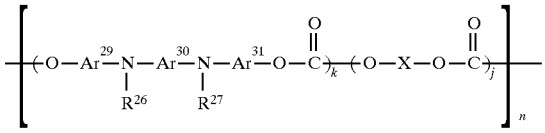

(12)

wherein $R^{26}$ and $R^{27}$ are each independently an aryl group which may have a substituent; $Ar^{29}$, $Ar^{30}$ and $Ar^{31}$, which may be the same or different, are each independently an arylene group; $0.1 \leqq k \leqq 1$; $0 \leqq j \leqq 0.9$; n is an integer of 5 to 5,000; and X is the same as that previously defined in formula (3).

Examples of the aryl group represented by $R^{26}$ and $R^{27}$ are the same as those represented by $R^9$ and $R^{10}$ mentioned in the compound of formula (5).

As the arylene group represented by $Ar^{29}$ to $Ar^{31}$, there can be employed bivalent groups derived from the above-mentioned examples of the aryl group represented by $R^{26}$ and $R^{27}$.

The above-mentioned aryl group and arylene group may have a substituent.

The same substituents for the aryl group and arylene group as mentioned in the compound of formula (5) can be employed for $R^{26}$ and $R^{27}$ and $Ar^{29}$ to $Ar^{31}$.

Furthermore, the above-mentioned high-molecular weight compound of formula (12) may be produced in such a manner that a diol compound having triarylamino group represented by the following formula (12') is subjected to polymerization by the phosgene method or ester interchange method using a diol compound of formula (100) in combination, so that X is introduced into the main chain of the obtained compound:

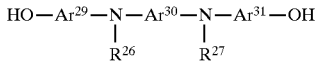

(12')

HO—X—OH (100)

wherein $R^{26}$ and $R^{27}$, $Ar^{29}$ to $Ar^{31}$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (12') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

Examples of the binder resin which can be used in combination with the above-mentioned polycarbonate resin in the charge transport layer 33 include polycarbonate (bisphenol A type and bisphenol Z type), polyester, methacrylic resin, acrylic resin, polyethylene, vinyl chloride, vinyl acetate, polystyrene, phenolic resin, epoxy resin, polyurethane, polyvinylidene chloride, alkyd resin, silicone resin, polyvinylcarbazole, polyvinyl butyral, polyvinyl formal, polyacrylate, polyacrylamide, and phenoxy resin.

Those binder resins may be used alone or in combination.

The charge transport layer 33 may further comprise a low-molecular weight charge transport material. In this case, the same low-molecular weight charge transport materials as explained in the description of the charge generation layer 31 are usable. The amount of low-molecular weight charge transport material in the charge transport layer 33 may be as small as possible in light of the abrasion resistance of the obtained charge transport layer 33.

Further, the charge transport layer 33 may further comprise a plasticizer and a leveling agent.

Any plasticizers that are contained in the general-purpose resins, such as dibutyl phthalate and dioctyl phthalate can be used as they are. It is proper that the amount of plasticizer be in the range of 0 to about 30 parts by weight to 100 parts by weight of the binder resin for use in the charge transport layer 33.

As the leveling agent for use in the charge transport layer 33, there can be employed silicone oils such as dimethyl silicone oil and methylphenyl silicone oil, and polymers and oligomers having a perfluoroalkyl group on the side chain thereof. The proper amount of leveling agent is at most one part by weight to 100 parts by weight of the binder resin for use in the charge transport layer 33.

As shown in FIG. 1, when the photoconductive layer 23 is of a single-layered type, the above-mentioned charge generation material, that is, at least one of the azo compound of formula (1) or (2), and the polycarbonate having a triarylamine structure in the main chain and/or side chain thereof are contained in the photoconductive layer 23.

The photoconductive layer 23 may further comprise the above-mentioned plasticizer and leveling agent when necessary. In addition, the photoconductive layer 23 may further comprise the same binder resin as employed in the charge transport layer 33 alone, or in combination with the same binder resin as in the charge generation layer 31.

In the electrophotographic photoconductor according to the present invention, an intermediate layer 25 may be interposed between the electroconductive support 21 and the photoconductive layer 23 in order to increase the adhesiveness therebetween, prevent the occurrence of Moiré, improve the coating characteristics of the photoconductive layer 23, and reduce the residual potential. When the photoconductor comprises the photoconductive layer 23' of a laminated type, the intermediate layer 25 may be interposed between the electroconductive support 21 and the charge generation layer 31, as shown in FIG. 3.

The intermediate layer 25 comprises a resin as the main component. The photoconductive layer 23 is provided on the intermediate layer 25 by coating method using a solvent, so that it is desirable that the resin for use in the intermediate layer 25 have high resistance against general-purpose organic solvents.

Preferable examples of the resin for use in the intermediate layer 25 include water-soluble resins such as polyvinyl alcohol, casein and sodium polyacrylate; alcohol-soluble resins such as copolymer nylon and methoxymethylated nylon; and hardening resins with three-dimensional network such as polyurethane, melamine resin, alkyd-melamine resin and epoxy resin.

The intermediate layer 25 may further comprise finely-divided particles of metallic oxides such as titanium oxide, silica, alumina, zirconium oxide, tin oxide and indium oxide; metallic sulfides; or metallic nitrides.

Similar to the photoconductive layer 23, the intermediate layer 25 can be provided on the electroconductive support 21 by coating method, using an appropriate solvent.

Further, the intermediate layer 25 for use in the present invention may be a metallic oxide layer prepared by the sol-gel processing using a coupling agent such as silane coupling agent, titanium coupling agent or chromium coupling agent.

Furthermore, to prepare the intermediate layer 25, $Al_2O_3$ may be deposited on the electroconductive support 21 by the anodizing process, or an organic material such as poly-para-xylylene (parylene), or inorganic materials such as SiO, $SnO_2$, $TiO_2$, ITO and $CeO_2$ may be deposited on the electroconductive support 21 by vacuum thin-film forming method.

It is preferable that the thickness of the intermediate layer 25 be 5 $\mu$m or less.

In the electrophotographic photoconductor of the present invention, an antioxidant may be contained in any layer that contains an organic material therein in order to improve the environmental resistance, to be more specific, to prevent the decrease of photosensitivity and the increase of residual potential. In particular, satisfactory results can be obtained when the antioxidant is added to the layer which comprises the charge transport material.

Examples of the antioxidants for use in the present invention are as follows:

(1) Monophenol compounds 2,6-di-t-butyl-p-cresol, butylated hydroxyanisole, 2,6-di-t-butyl-4-ethylphenol, and stearyl-β-(3,5-di-t-butyl-4-hydroxyphenyl)propionate.

(2) Bisphenol compounds 2,2'-methylene-bis-(4-methyl-6-t-butylphenol), 2,2'-methylene-bis-(4-ethyl-6-t-butylphenol), 4,4'-thiobis-(3-methyl-6-t-butylphenol), and 4,4'butylidenebis-(3-methyl-6-t-butylphenol).

(3) Polymeric phenol compounds 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, and tocopherol.

(4) Paraphenylenediamine compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

(5) Hydroquinone compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

(6) Organic sulfur-containing compounds

Dilauryl-3,3'-thiodipropionate, distearyl-3,3'-thiodipropionate, and ditetradecyl-3,3'-thiodipropionate.

(7) Organic phosphorus-containing compounds

Triphenylphosphine, tri(nonylphenyl)phosphine, tri (dinonylphenyl)phosphine, tricresylphosphine, and tri(2,4-dibutylphenoxy)phosphine.

The above-mentioned compounds (1) to (7) are available from the commercially available antioxidants for rubbers, plastic materials, and fats and oils.

It is preferable that the amount of antioxidant be in the range of 0.5 to 30 parts by weight, to 100 parts by weight of the charge transport material.

Other features of this invention will become apparent in the course of the following description of exemplary embodiments, which are given for illustration of the invention and are not intended to be limiting thereof.

EXAMPLE 1

<Fabrication of Electrophotographic Photoconductor No. 1>

[Formation of Intermediate Layer]

A mixture of the following components was dispersed to prepare a coating liquid for an intermediate layer:

| | Parts by Weight |
|---|---|
| Alkyd resin (Trademark "Beckosol 1307-60-EL", made by Dainippon Ink & Chemicals, Incorporated) | 6 |
| Melamine resin (Trademark "Super Beckamine G-821-60", made by Dainippon Ink & Chemicals, Incorporated) | 4 |
| Titanium oxide | 40 |
| Methyl ethyl ketone | 200 |

The thus prepared coating liquid was coated on the outer surface of an aluminum drum with a diameter of 60 mm and dried. Thus, an intermediate layer with a thickness of 3.5 $\mu$m was provided on the aluminum drum.

[Formation of Charge Generation Layer]

A mixture of the following components was dispersed to prepare a coating liquid for a charge generation layer:

| | Parts by Weight |
|---|---|
| Polyvinyl butyral (Trademark "S-Lec BL-1", made by Sekisui Chemical Co., Ltd.) | 0.5 |
| Cyclohexanone | 200 |
| Methyl ethyl ketone | 80 |
| Disazo pigment of the following formula: | 2.5 |

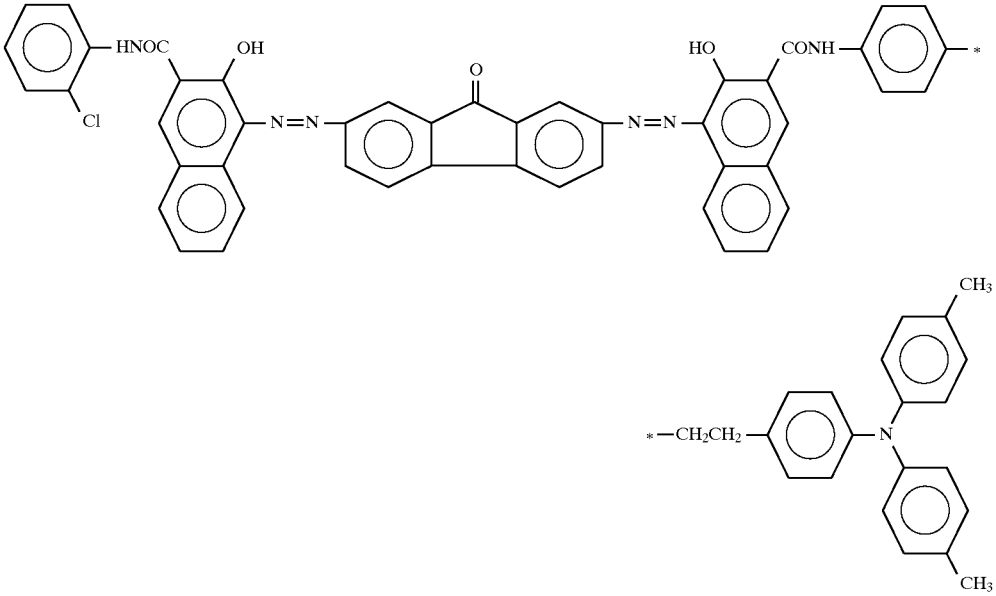

The thus obtained coating liquid was coated on the above prepared intermediate layer and dried, so that a charge generation layer with a thickness of 0.2 μm was provided on the intermediate layer.

[Formation of Charge Transport Layer]

The following components were mixed to prepare a coating liquid for a charge transport layer:

| | Parts by Weight |
|---|---|
| Methylene chloride | 100 |
| High-molecular weight charge transport material comprising a repeat unit of the following formula: | 8 |

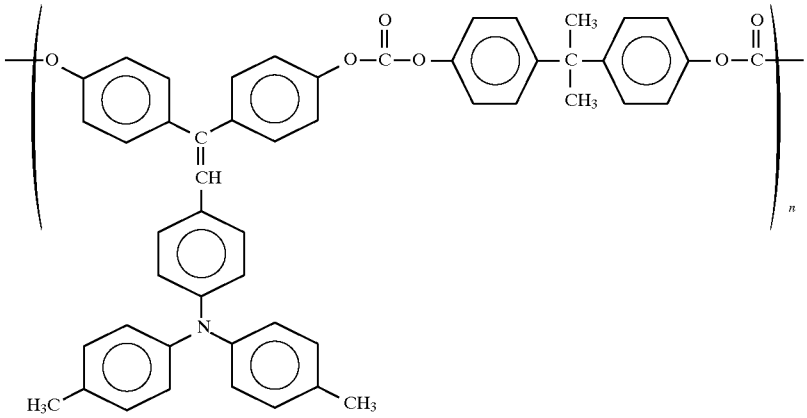

The thus prepared coating liquid was coated on the above prepared charge generation layer and dried, so that a charge transport layer with a thickness of 25 μm was provided on the charge generation layer.

Thus, an electrophotographic photoconductor No. 1 according to the present invention was fabricated.

EXAMPLE 2

The procedure for fabrication of the electrophotographic photoconductor No. 1 in Example 1 was repeated except that the disazo pigment serving as the charge generation material used in the coating liquid for the charge generation layer in Example 1 was replaced by the following disazo pigment:

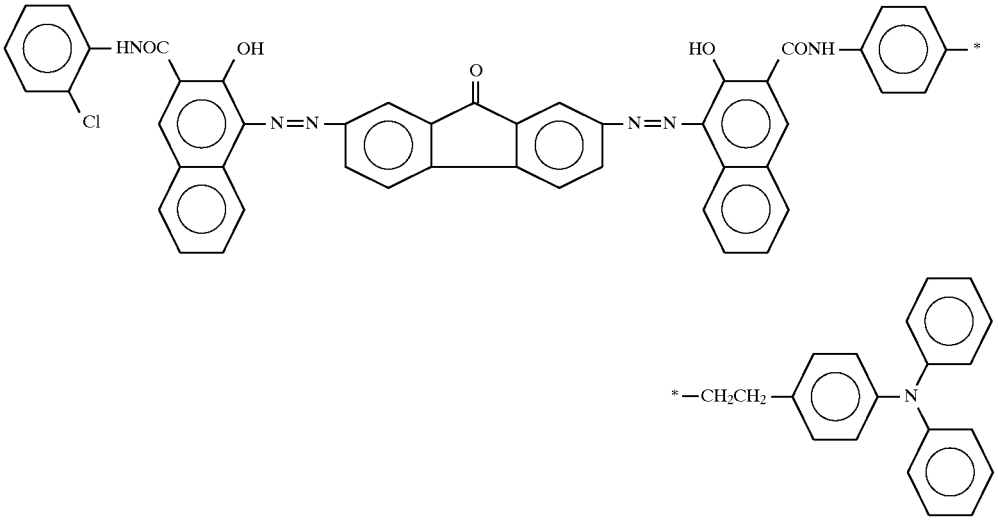

Thus, an electrophotographic photoconductor No. 2 according to the present invention was fabricated.

Comparative Example 1

The procedure for fabrication of the electrophotographic photoconductor No. 1 in Example 1 was repeated except that the disazo pigment serving as the charge generation material used in the coating liquid for the charge generation layer in Example 1 was replaced by the following charge generation material:

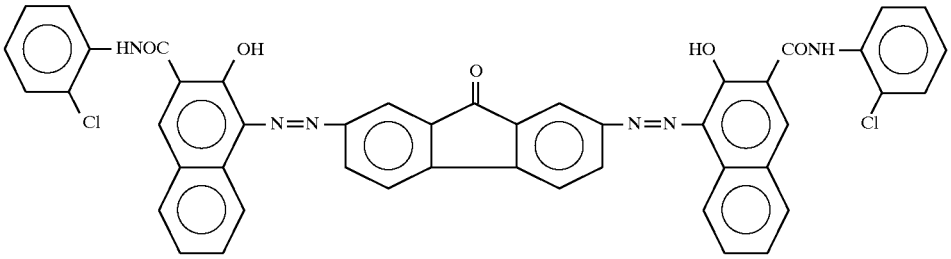

Thus, a comparative electrophotographic photoconductor No. 1 was fabricated.

Comparative Example 2

The procedure for fabrication of the electrophotographic photoconductor No. 1 in Example 1 was repeated except that the disazo pigment serving as the charge generation material used in the coating liquid for the charge generation layer in Example 1 was replaced by the following charge generation material:

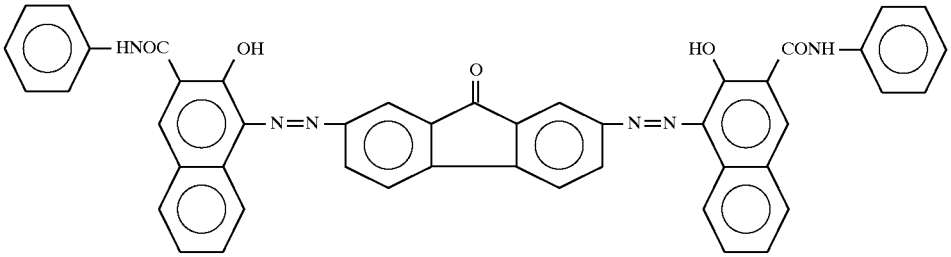

Thus, a comparative electrophotographic photoconductor No. 2 was fabricated.

EXAMPLE 3

The procedure for fabrication of the electrophotographic photoconductor No. 1 in Example 1 was repeated except that the high-molecular weight charge transport material used in the coating liquid for the charge transport layer in Example 1 was replaced by a high-molecular weight charge transport material comprising the repeat unit of the following formula:

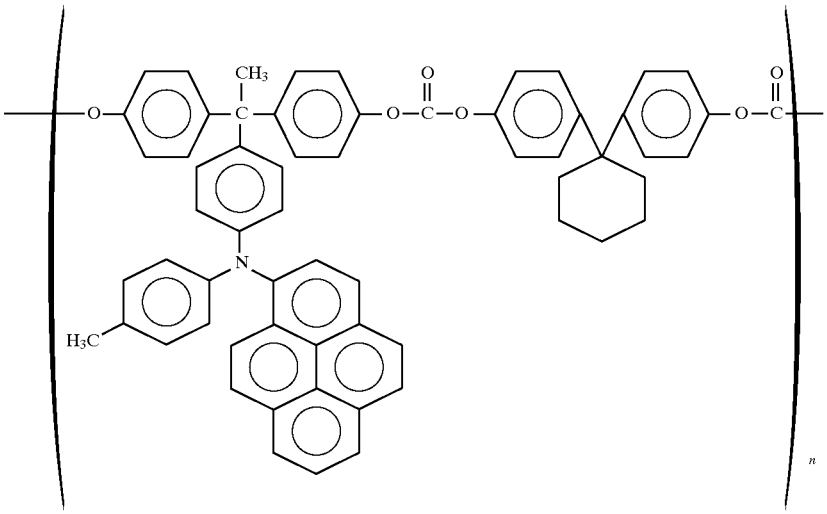

Thus, an electrophotographic photoconductor No. 3 according to the present invention was fabricated.

EXAMPLE 4

The procedure for fabrication of the electrophotographic photoconductor No. 1 in Example 1 was repeated except that the high-molecular weight charge transport material used in the coating liquid for the charge transport layer in Example 1 was replaced by a high-molecular weight charge transport material comprising the repeat unit of the following formula:

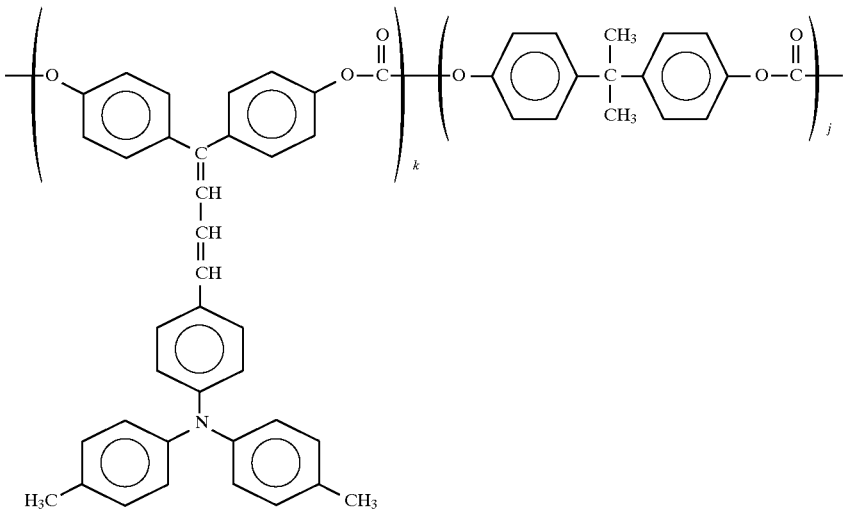

Random copolymer (k = 0.4, j = 0.6)

Thus, an electrophotographic photoconductor No. 4 according to the present invention was fabricated.

EXAMPLE 5

The procedure for fabrication of the electrophotographic photoconductor No. 1 in Example 1 was repeated except that the high-molecular weight charge transport material used in the coating liquid for the charge transport layer in Example 1 was replaced by a high-molecular weight charge transport material comprising the repeat unit of the following formula:

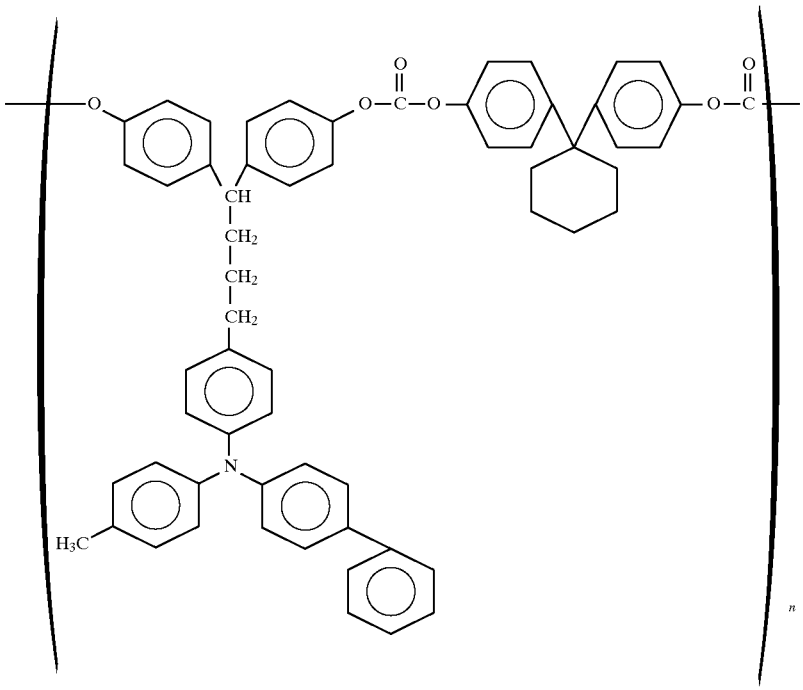

Thus, an electrophotographic photoconductor No. 5 according to the present invention was fabricated.

EXAMPLE 6

The procedure for fabrication of the electrophotographic photoconductor No. 1 in Example 1 was repeated except that the high-molecular weight charge transport material used in the coating liquid for the charge transport layer in Example 1 was replaced by a high-molecular weight charge transport material comprising the repeat unit of the following formula:

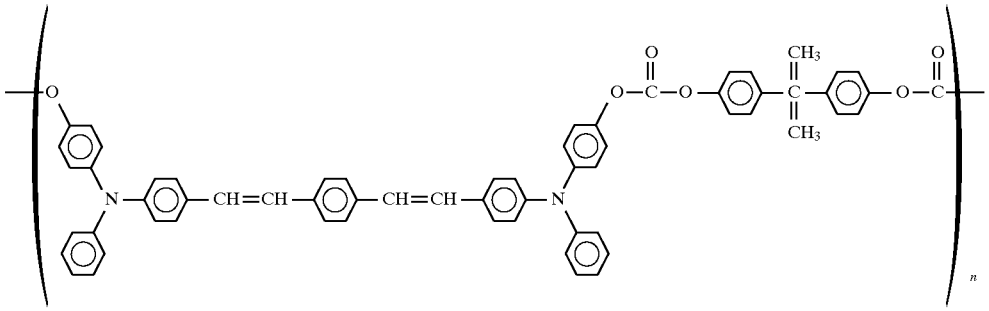

Thus, an electrophotographic photoconductor No. 6 according to the present invention was fabricated.

EXAMPLE 7

The procedure for fabrication of the electrophotographic photoconductor No. 1 in Example 1 was repeated except that the high-molecular weight charge transport material used in the coating liquid for the charge transport layer in Example 1 was replaced by a high-molecular weight charge transport material comprising the repeat unit of the following formula:

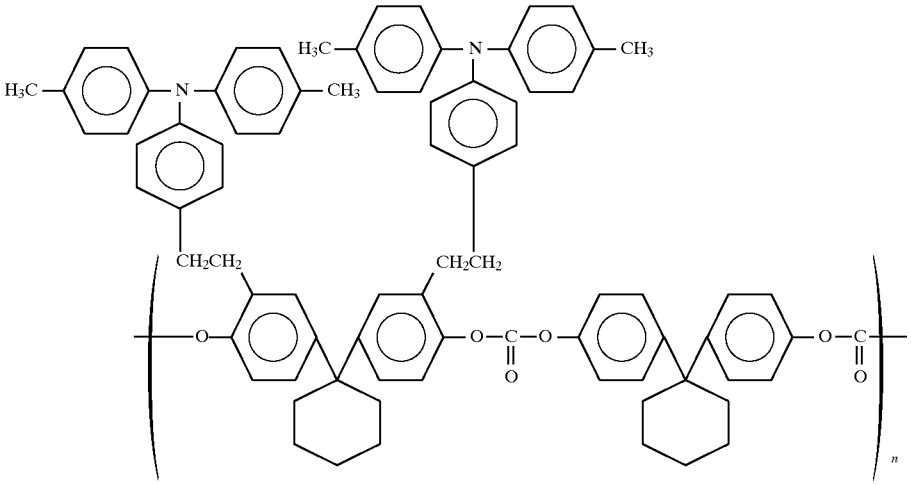

Thus, an electrophotographic photoconductor No. 7 according to the present invention was fabricated.

EXAMPLE 8

The procedure for fabrication of the electrophotographic photoconductor No. 1 in Example 1 was repeated except that the high-molecular weight charge transport material used in the coating liquid for the charge transport layer in Example 1 was replaced by a high-molecular weight charge transport material comprising the repeat unit of the following formula:

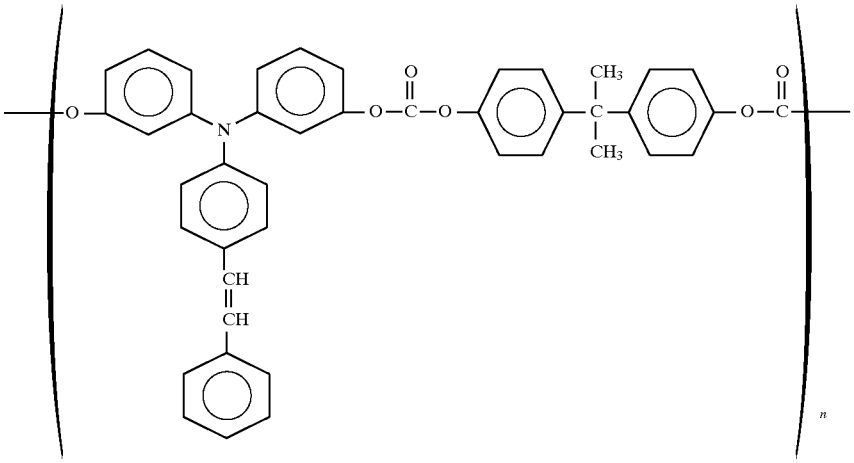

Thus, an electrophotographic photoconductor No. 8 according to the present invention was fabricated.

EXAMPLE 9

The procedure for fabrication of the electrophotographic photoconductor No. 1 in Example 1 was repeated except that the high-molecular weight charge transport material used in the coating liquid for the charge transport layer in Example 1 was replaced by a high-molecular weight charge transport material comprising the repeat unit of the following formula:

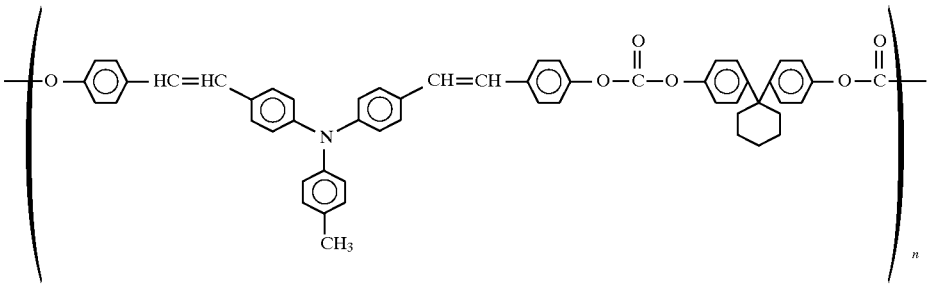

Thus, an electrophotographic photoconductor No. 9 according to the present invention was fabricated.

EXAMPLE 10

The procedure for fabrication of the electrophotographic photoconductor No. 1 in Example 1 was repeated except that the high-molecular weight charge transport material used in the coating liquid for the charge transport layer in Example 1 was replaced by a high-molecular weight charge transport material comprising the repeat unit of the following formula:

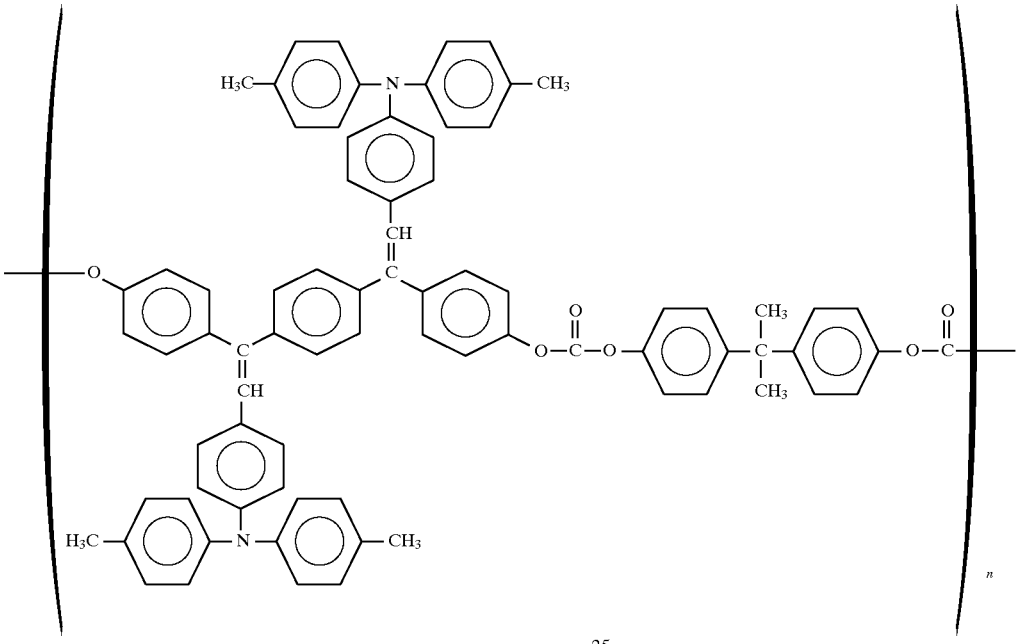

Thus, an electrophotographic photoconductor No. 10 according to the present invention was fabricated.

EXAMPLE 11

The procedure for fabrication of the electrophotographic photoconductor No. 1 in Example 1 was repeated except that the high-molecular weight charge transport material used in the coating liquid for the charge transport layer in Example 1 was replaced by a high-molecular weight charge transport material comprising the repeat unit of the following formula:

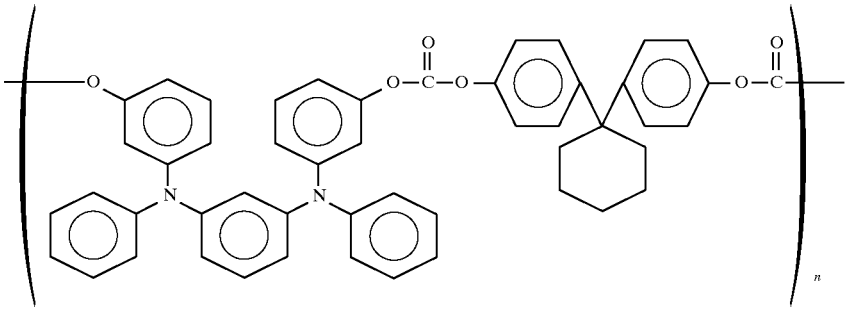

Thus, an electrophotographic photoconductor No. 11 according to the present invention was fabricated.

Comparative Example 3

The procedure for fabrication of the electrophotographic photoconductor No. 1 in Example 1 was repeated except that the formulation for the coating liquid of the charge transport layer employed in Example 1 was changed to the following formulation for the charge transport layer coating liquid:

| | Parts by Weight |
|---|---|
| Polycarbonate (Trademark "Panlite K1300", made by Teijin Chemicals Ltd.) | 10 |
| Methylene chloride | 250 |

-continued

| | Parts by Weight |
|---|---|
| Low-molecular weight charge transport material of the following formula: | 8 |

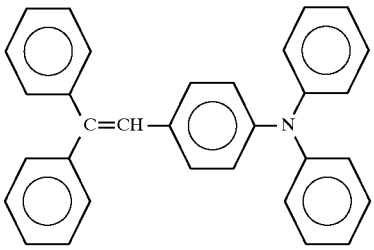

Thus, a comparative electrophotographic photoconductor No. 3 was fabricated.

Comparative Example 4

The procedure for fabrication of the electrophotographic photoconductor No. 1 in Example 1 was repeated except that the formulation for the coating liquid of the charge transport layer employed in Example 1 was changed to the following formulation for the charge transport layer coating liquid:

| | Parts by Weight |
|---|---|
| Polycarbonate (Trademark "IUPILON Z-200", made by Mitsubishi Gas Chemical Company, Inc.) | 10 |
| Methylene chloride | 200 |
| Low-molecular weight charge transport material of the following formula: | 9 |

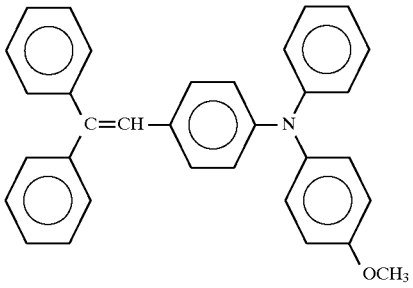

Thus, a comparative electrophotographic photoconductor No. 4 was fabricated.

Each of the above fabricated electrophotographic photoconductors No. 1 to No. 11 according to the present invention and comparative electrophotographic photoconductors No. 1 to No. 4 was charged negatively in the dark under application of −6 kV of corona charge for 20 seconds, using the electrophotographic properties testing apparatus disclosed in Japanese Laid-Open Patent Application 60-100167. Then, each photoconductor was allowed to stand in the dark for 20 seconds without the application of any charge thereto, and the surface potential (V) was measured after dark decay.

Each photoconductor was then illuminated by a light beam with a wavelength of 580±10 nm and a light volume of 2.5 $\mu$W/cm$^2$, and the exposure $E_{1/2}$ ($\mu$J/cm$^2$) required to reduce the above-mentioned surface potential (V) to ½ the surface potential (V) was measured.

Furthermore, each photoconductor was incorporated in a commercially available copying machine (Trademark "SPIRIO 3550", made by Ricoh Company, Ltd.). After 30,000 copies were continuously made, the image obtained on the last copy paper was evaluated. In addition, a decrease ($\mu$m) in thickness of the charge transport layer was measured after making of 30,000 copies.

The results are shown in TABLE 15.

TABLE 15

| | $E_{1/2}$ ($\mu$J/cm$^2$) | Decrease in Thickness of CTL ($\mu$m) | Image Quality after Making of 30,000 Copies |
|---|---|---|---|
| Ex. 1 | 0.28 | 0.9 | Excellent |
| Ex. 2 | 0.35 | 0.9 | Excellent |
| Comp. Ex. 1 | 0.93 | 0.9 | Toner deposition on background |
| Comp. Ex. 2 | 2.01 | 0.9 | Toner deposition on background |
| Ex. 3 | 0.33 | 1.3 | Excellent |
| Ex. 4 | 0.30 | 1.2 | Excellent |
| Ex. 5 | 0.32 | 1.3 | Excellent |
| Ex. 6 | 0.29 | 1.0 | Excellent |
| Ex. 7 | 0.31 | 1.4 | Excellent |
| Ex. 8 | 0.33 | 1.1 | Excellent |
| Ex. 9 | 0.34 | 0.9 | Excellent |
| Ex. 10 | 0.27 | 1.4 | Excellent |
| Ex. 11 | 0.30 | 1.0 | Excellent |
| Comp. Ex. 3 | 0.30 | 2.1 | Occurrence of abnormal image (black stripes) |
| Comp. Ex. 4 | 0.29 | 1.9 | Occurrence of abnormal image _ (black stripes) |

EXAMPLE 12

<Fabrication of Electrophotographic Photoconductor No. 12>

[Formation of Intermediate Layer]

A mixture of the following components was dispersed to prepare a coating liquid for an intermediate layer:

| | Parts by Weight |
|---|---|
| Alkyd resin (Trademark "Beckosol 1307-60-EL", made by Dainippon Ink & Chemicals, Incorporated) | 6 |
| Melamine resin (Trademark "Super Beckamine G-821-60", made by Dainippon Ink & Chemicals, Incorporated) | 4 |
| Titanium oxide | 40 |
| Methyl ethyl ketone | 200 |

The thus prepared coating liquid was coated on the outer surface of an aluminum drum with a diameter of 80 mm and dried. Thus, an intermediate layer with a thickness of 3.5 $\mu$m was provided on the aluminum drum.

[Formation of Charge Generation Layer]

A mixture of the following components was dispersed to prepare a coating liquid for a charge generation layer:

| | Parts by Weight |
|---|---|
| Polyvinyl butyral (Trademark "S-Lec BL-1", made by Sekisui Chemical Co., Ltd.) | 0.5 |
| Cyclohexanone | 200 |
| Methyl ethyl ketone | 80 |

-continued

| | Parts by Weight |
|---|---|
| Trisazo pigment of the following formula: | 2.5 |

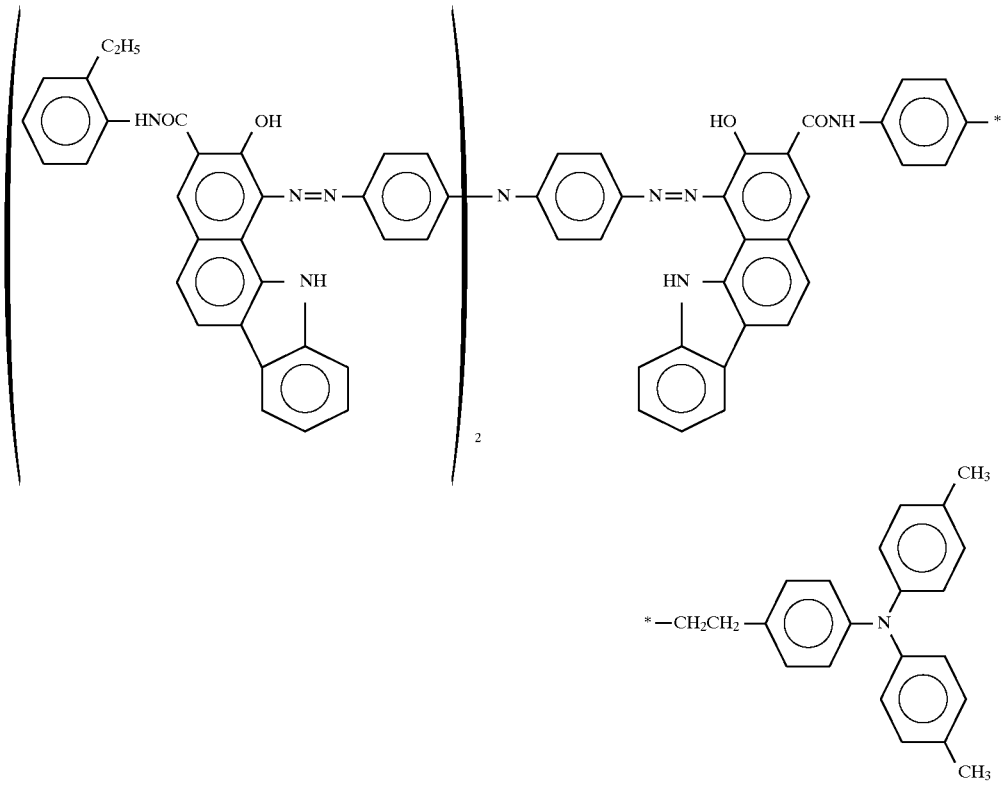

The thus obtained coating liquid was coated on the above prepared intermediate layer and dried, so that a charge generation layer with a thickness of 0.2 μm was provided on the intermediate layer.

[Formation of Charge Transport Layer]

The following components were mixed to prepare a coating liquid for a charge transport layer:

| | Parts by Weight |
|---|---|
| Methylene chloride | 100 |
| High molecular weight charge transport material comprising a repeat unit of the following formula: | 8 |

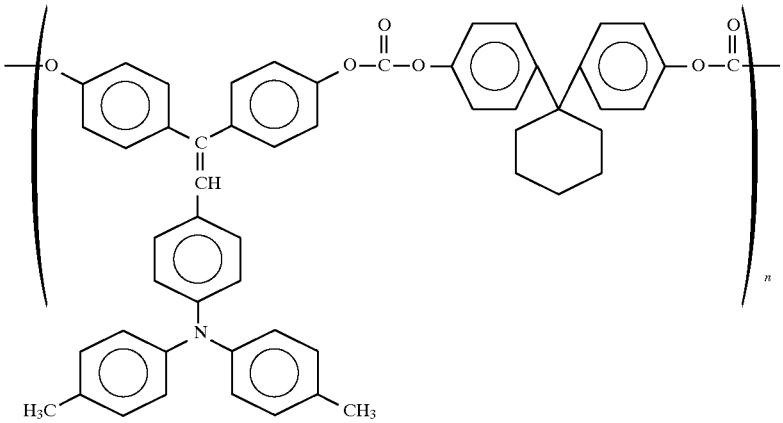

The thus prepared coating liquid was coated on the above prepared charge generation layer and dried, so that a charge transport layer with a thickness of 25 μm was provided on the charge generation layer.

Thus, an electrophotographic photoconductor No. 12 according to the present invention was fabricated.

EXAMPLE 13

The procedure for fabrication of the electrophotographic photoconductor No. 12 in Example 12 was repeated except that the trisazo pigment serving as the charge generation material used in the coating liquid for the charge generation layer in Example 12 was replaced by the following trisazo pigment:

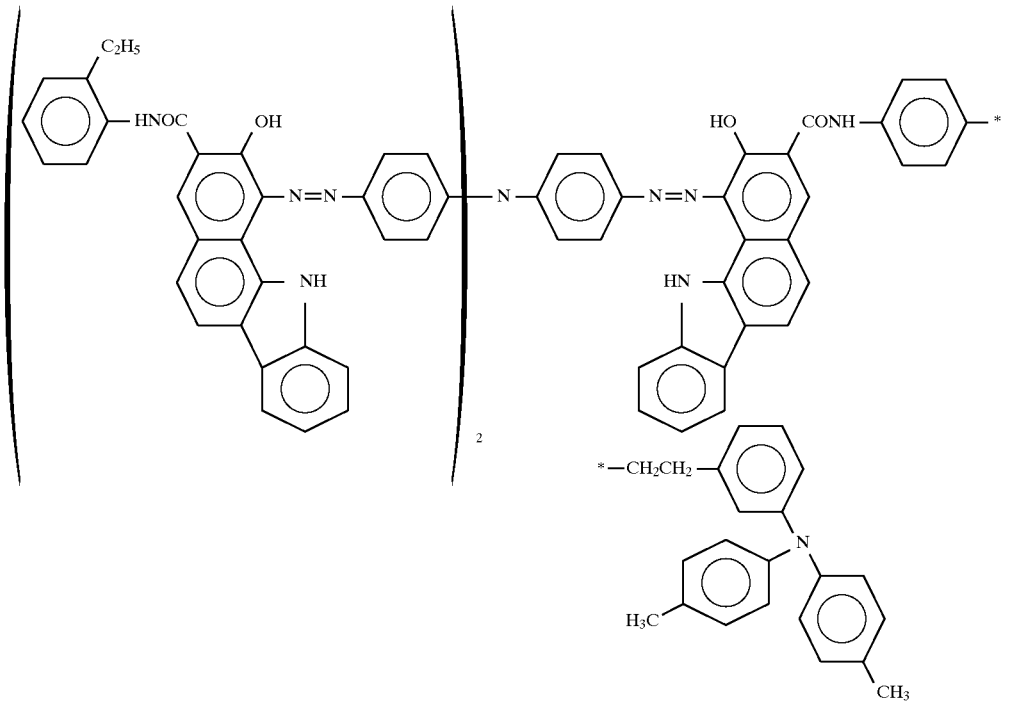

Thus, an electrophotographic photoconductor No. 13 according to the present invention was fabricated.

Comparative Example 5

The procedure for fabrication of the electrophotographic photoconductor No. 12 in Example 12 was repeated except that the trisazo pigment serving as the charge generation material used in the coating liquid for the charge generation layer in Example 12 was replaced by the following charge generation material:

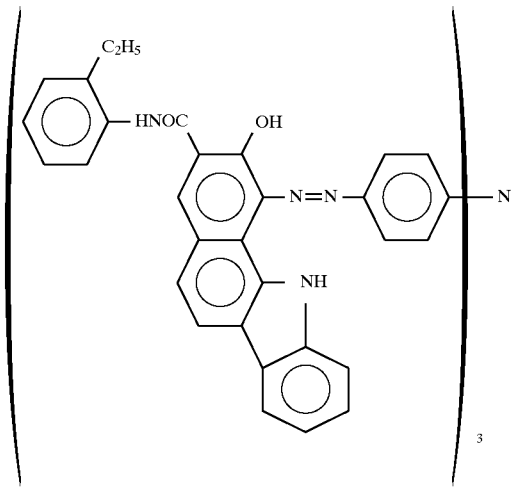

Thus, a comparative electrophotographic photoconductor No. 5 was fabricated.

Comparative Example 6

The procedure for fabrication of the electrophotographic photoconductor No. 12 in Example 12 was repeated except that the trisazo pigment serving as the charge generation material used in the coating liquid for the charge generation layer in Example 12 was replaced by the following charge generation material:

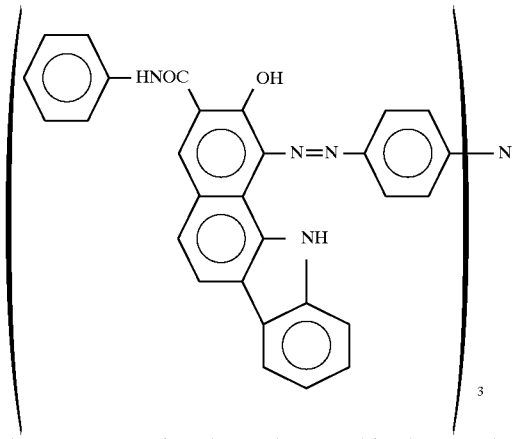

Thus, a comparative electrophotographic photoconductor No. 6 was fabricated.

EXAMPLE 14

The procedure for fabrication of the electrophotographic photoconductor No. 12 in Example 12 was repeated except that the high-molecular weight charge transport material used in the coating liquid for the charge transport layer in Example 12 was replaced by a high-molecular weight charge transport material comprising a repeat unit of the following formula:

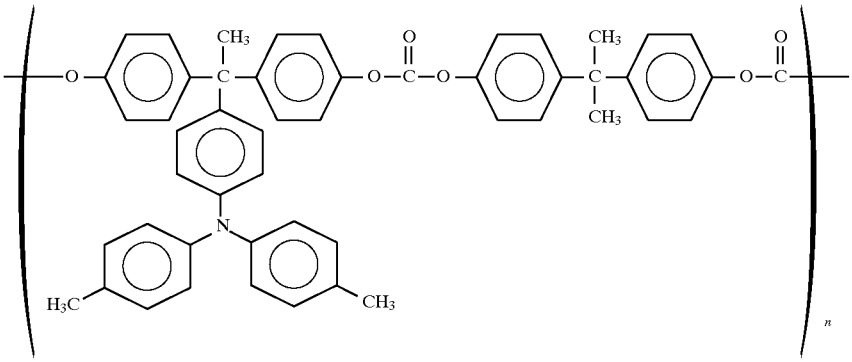

Thus, an electrophotographic photoconductor No. 14 according to the present invention was fabricated.

EXAMPLE 15

The procedure for fabrication of the electrophotographic photoconductor No. 12 in Example 12 was repeated except that the high-molecular weight charge transport material used in the coating liquid for the charge transport layer in Example 12 was replaced by a high-molecular weight charge transport material comprising a repeat unit of the following formula:

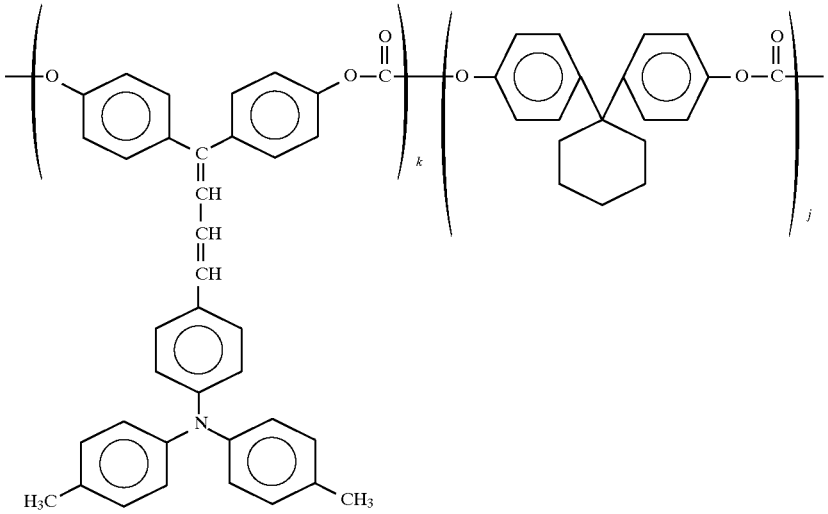

Random copolymer (k = 0.4, j = 0.6)

Thus, an electrophotographic photoconductor No. 15 according to the present invention was fabricated.

EXAMPLE 16

The procedure for fabrication of the electrophotographic photoconductor No. 12 in Example 12 was repeated except that the high-molecular weight charge transport material used in the coating liquid for the charge transport layer in Example 12 was replaced by a high-molecular weight charge transport material comprising a repeat unit of the following formula:

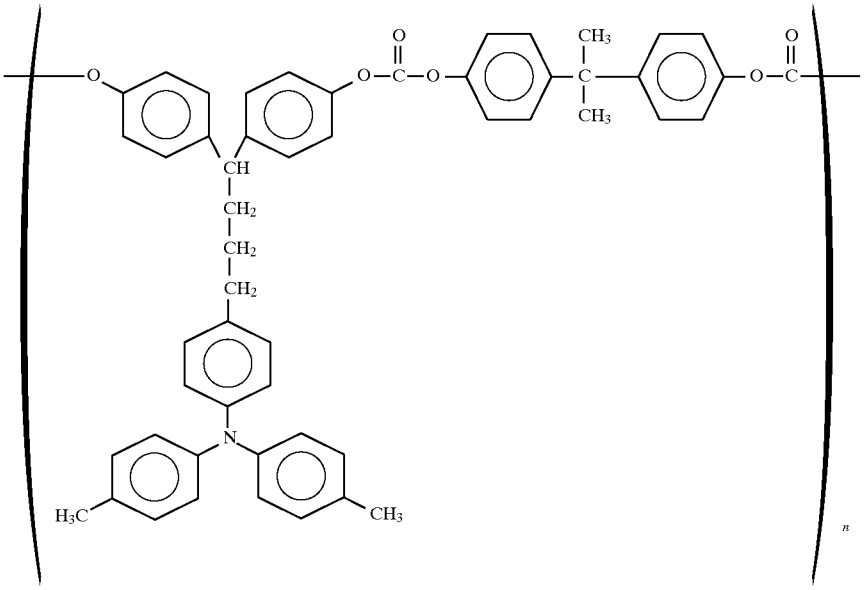

Thus, an electrophotographic photoconductor No. 16 according to the present invention was fabricated.

EXAMPLE 17

The procedure for fabrication of the electrophotographic photoconductor No. 12 in Example 12 was repeated except that the high-molecular weight charge transport material used in the coating liquid for the charge transport layer in Example 12 was replaced by a high-molecular weight charge transport material comprising a repeat unit of the following formula:

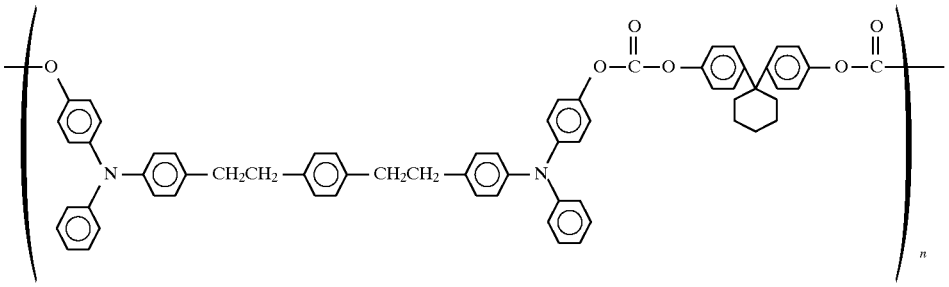

Thus, an electrophotographic photoconductor No. 17 according to the present invention was fabricated.

EXAMPLE 18

The procedure for fabrication of the electrophotographic photoconductor No. 12 in Example 12 was repeated except that the high-molecular weight charge transport material used in the coating liquid for the charge transport layer in Example 12 was replaced by a high-molecular weight charge transport material comprising a repeat unit of the following formula:

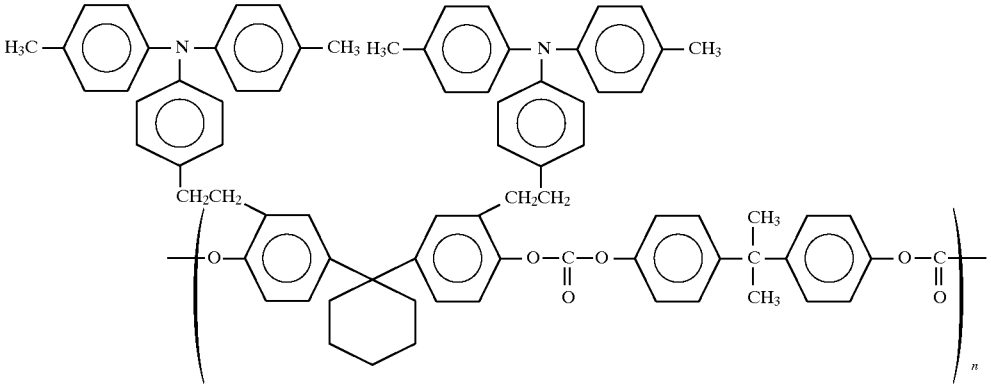

Thus, an electrophotographic photoconductor No. 18 according to the present invention was fabricated.

EXAMPLE 19

The procedure for fabrication of the electrophotographic photoconductor No. 12 in Example 12 was repeated except that the high-molecular weight charge transport material used in the coating liquid for the charge transport layer in Example 12 was replaced by a high-molecular weight charge transport material comprising a repeat unit of the following formula:

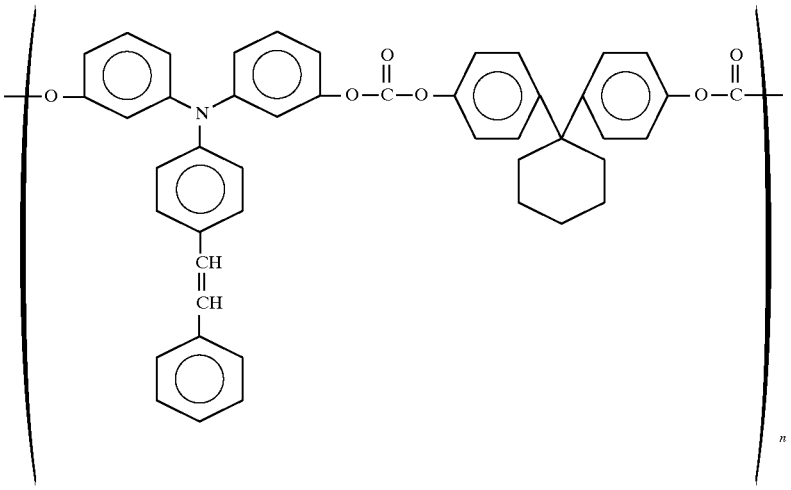

Thus, an electrophotographic photoconductor No. 19 according to the present invention was fabricated.

EXAMPLE 20

The procedure for fabrication of the electrophotographic photoconductor No. 12 in Example 12 was repeated except that the high-molecular weight charge transport material used in the coating liquid for the charge transport layer in Example 12 was replaced by a high-molecular weight charge transport material comprising a repeat unit of the following formula:

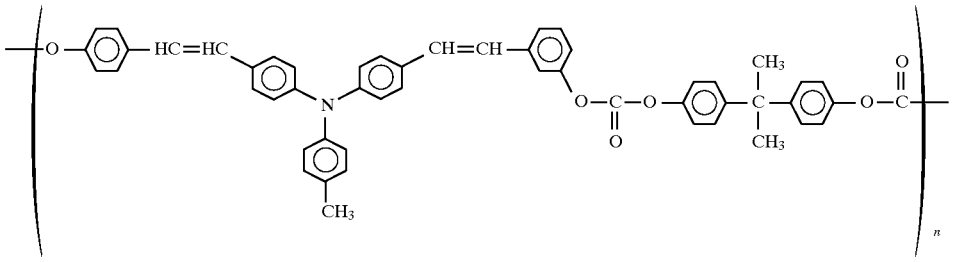

Thus, an electrophotographic photoconductor No. 20 according to the present invention was fabricated.

EXAMPLE 21

The procedure for fabrication of the electrophotographic photoconductor No. 12 in Example 12 was repeated except that the high-molecular weight charge transport material used in the coating liquid for the charge transport layer in Example 12 was replaced by a high-molecular weight charge transport material comprising a repeat unit of the following formula:

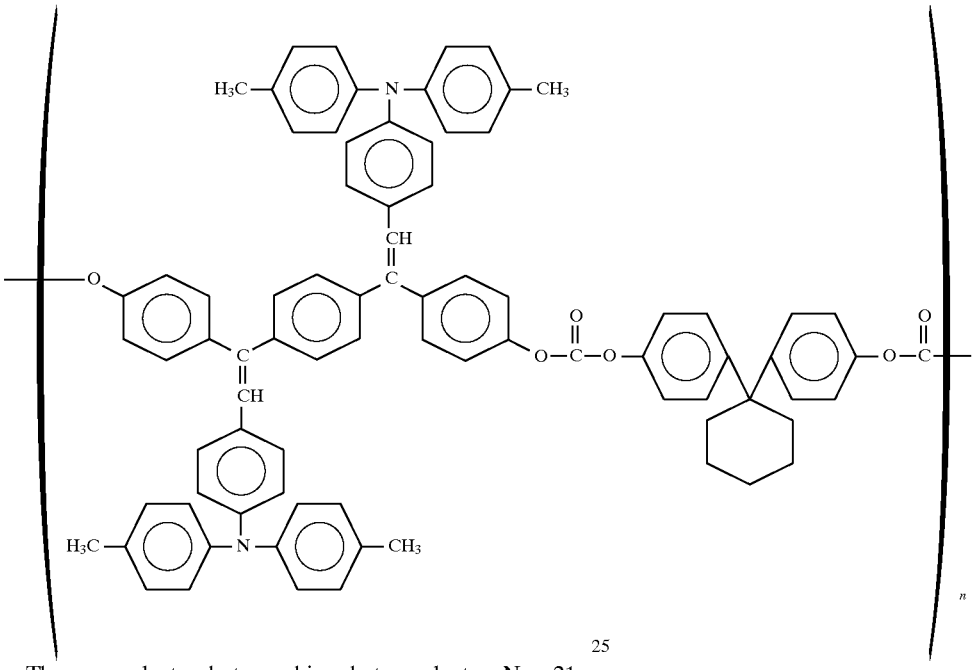

Thus, an electrophotographic photoconductor No. 21 according to the present invention was fabricated.

EXAMPLE 22

The procedure for fabrication of the electrophotographic photoconductor No. 12 in Example 12 was repeated except that the high-molecular weight charge transport material used in the coating liquid for the charge transport layer in Example 12 was replaced by a high-molecular weight charge transport material comprising a repeat unit of the following formula:

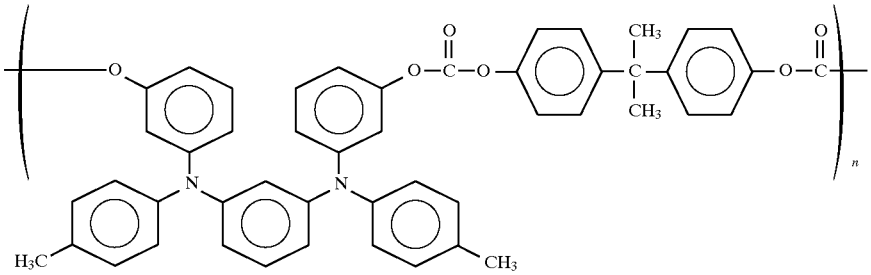

Thus, an electrophotographic photoconductor No. 22 according to the present invention was fabricated.

Comparative Example 7

The procedure for fabrication of the electrophotographic photoconductor No. 12 in Example 12 was repeated except that the formulation for the coating liquid of the charge transport layer employed in Example 12 was changed to the following formulation for the charge transport layer coating liquid:

| | Parts by Weight |
|---|---|
| Polycarbonate (Trademark "Panlite K1300", made by Teijin Chemicals Ltd.) | 10 |
| Methylene chloride | 250 |
| Low-molecular weight charge transport material of the following formula: | 8 |

-continued

| | Parts by Weight |
|---|---|
| 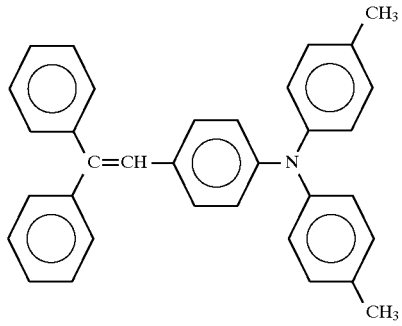 | |

Thus, a comparative electrophotographic photoconductor No. 7 was fabricated.

Comparative Example 8

The procedure for fabrication of the electrophotographic photoconductor No. 12 in Example 12 was repeated except that the formulation for the coating liquid of the charge transport layer employed in Example 12 was changed to the following formulation for the charge transport layer coating liquid:

| | Parts by Weight |
|---|---|
| Polycarbonate (Trademark "IUPILON Z-200", made by Mitsubishi Gas Chemical Company, Inc.) | 10 |
| Methylene chloride | 200 |
| Low-molecular weight charge transport material of the following formula: | 9 |
| 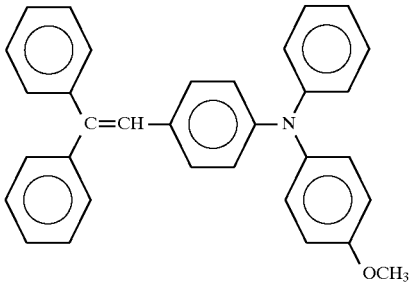 | |

Thus, a comparative electrophotographic photoconductor No. 8 was fabricated.

Each of the above fabricated electrophotographic photoconductors No. 12 to No. 22 according to the present invention and comparative electrophotographic photoconductors No. 5 to No. 8 was charged negatively in the dark under application of −6 kV of corona charge for 20 seconds, using the electrophotographic properties testing apparatus disclosed in Japanese Laid-Open Patent Application 60-100167. Then, each photoconductor was allowed to stand in the dark for 20 seconds without the application of any charge thereto, and the surface potential (V) was measured after dark decay.

Each photoconductor was then illuminated by a light beam with a wavelength of 700±10 nm and a light volume of 2.5 $\mu$W/cm$^2$, and the exposure $E_{1/2}$ ($\mu$J/cm$^2$) required to reduce the above-mentioned surface potential (V) to ½ the surface potential (V) was measured.

Furthermore, each photoconductor was incorporated in a commercially available copying machine (Trademark "IMAGIO MF530", made by Ricoh Company, Ltd.). After 30,000 copies were continuously made, the image obtained on the last copy paper was evaluated. In addition, a decrease ($\mu$m) in thickness of the charge transport layer was measured after making of 30,000 copies.

The results are shown in TABLE 16.

TABLE 16

| | $E_{1/2}$ ($\mu$J/cm$^2$) | Decrease in Thickness of CTL ($\mu$m) | Image Quality after Making of 30,000 Copies |
|---|---|---|---|
| Ex. 12 | 0.45 | 0.8 | Excellent |
| Ex. 13 | 0.48 | 0.8 | Excellent |
| Comp. Ex. 5 | 0.83 | 0.8 | Decrease of image density |
| Comp. Ex. 6 | 3.51 | 0.8 | Decrease of image density |
| Ex. 14 | 0.55 | 1.5 | Excellent |
| Ex. 15 | 0.52 | 1.3 | Excellent |
| Ex. 16 | 0.53 | 1.4 | Excellent |
| Ex. 17 | 0.51 | 1.2 | Excellent |
| Ex. 18 | 0.49 | 1.5 | Excellent |
| Ex. 19 | 0.52 | 1.2 | Excellent |
| Ex. 20 | 0.48 | 1.1 | Excellent |
| Ex. 21 | 0.43 | 1.5 | Excellent |
| Ex. 22 | 0.50 | 1.2 | Excellent |
| Comp. Ex. 7 | 0.44 | 2.1 | Occurrence of abnormal image (black stripes) |
| Comp. Ex. 8 | 0.49 | 1.9 | Occurrence of abnormal image (black stripes) |

As previously explained, when the electrophotographic process is carried out for image formation using the photoconductor according to the present invention, occurrence of abnormal images can be minimized after the process is repeated for an extended period of time. This is because the decrease of the charging potential of a portion on the photoconductor corresponding to an image area can be effectively prevented during the repeated operations.

In addition, the photoconductive layer can be prevented from being scraped off while the electrophotographic process is repeated for a long time, so that excellent image quality can be obtained.

Japanese Patent Applications Nos. 09-074639 and 09-074645 filed Mar. 12, 1997, and two Japanese Patent Applications filed Mar. 11, 1998 are hereby incorporated by reference.

What is claimed is:

1. An electrophotographic photoconductor comprising an electroconductive support, and a photoconductive layer formed thereon which comprises a polycarbonate resin comprising a triarylamine structure on the main chain and/or side chain thereof, and at least one charge generation material selected from the group consisting of an azo compound represented by formula (1):

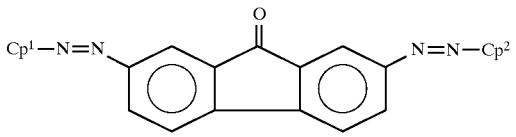

(1)

wherein $Cp^1$ and $Cp^2$ are each a coupler radical which may be the same or different, provided that at least $Cp^1$ or $Cp^2$ is a coupler radical component represented by formula (1-a);

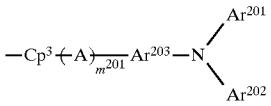

(I-a)

in which $Cp^3$ is a bivalent coupler radical; $Ar^{201}$ and $Ar^{202}$ are each an aryl group which may have a substituent; $Ar^{203}$ is an arylene group which may have a substituent; A is ethylene group, vinylene group, oxygen atom or sulfur atom; and $m^{201}$ is an integer of 0 to 2; and an azo compound represented by formula (2):

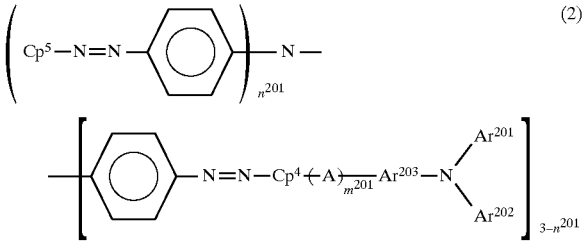

(2)

wherein $Cp^4$ is a bivalent coupler radical; $Cp^5$ is a monovalent coupler radical; $Ar^{201}$, $Ar^{202}$, $Ar^{203}$, A and $m^{201}$ are the same as those as previously defined in formula (1-a); and $n^{201}$ is an integer of 0 to 2.

2. An electrophotographic photoconductor comprising an electroconductive support, and a photoconductive layer formed thereon which comprises a polycarbonate resin comprising a triarylamine structure on the main chain and/or side chain thereof, and a charge generation material comprising an azo compound of formula (1):

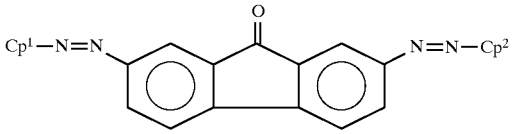

(1)

wherein $Cp^1$ and $Cp^2$ are each a coupler radical which may be the same or different, provided that at least $Cp^1$ or $Cp^2$ is a coupler radical component represented by formula (1-a);

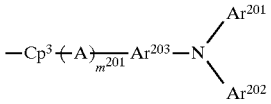

(I-a)

in which $Cp^3$ is a bivalent coupler radical; $Ar^{201}$ and $Ar^{202}$ are each an aryl group which may have a substituent; $Ar^{203}$ is an arylene group which may have a substituent; A is ethylene group, vinylene group, oxygen atom or sulfur atom; and $m^{201}$ is an integer of 0 to 2.

3. An electrophotographic photoconductor comprising an electroconductive support, and a photoconductive layer formed thereon which comprises a polycarbonate resin comprising a triarylamine structure on the main chain and/or side chain thereof, and a charge generation material comprising an azo compound represented by formula (2):

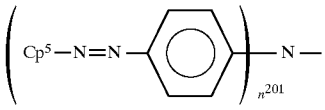

(2)

-continued

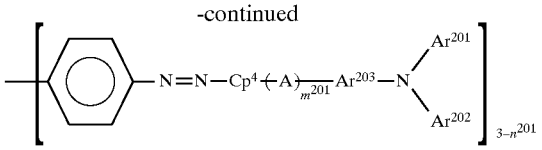

wherein $Cp^4$ is a bivalent coupler radical; $Cp^5$ is a monovalent coupler radical; $Ar^{201}$ and $Ar^{202}$ are each an aryl group which may have a substituent; $Ar^{203}$ is an arylene group which may have a substituent; A is ethylene group, vinylene group, oxygen atom or sulfur atom; $m^{201}$ is an integer of 0 to 2; and $n^{201}$ is an integer of 0 to 2.

4. The electrophotographic photoconductor as claimed in claim 1, wherein said photoconductive layer comprises a charge generation layer comprising said charge generation material selected from the group consisting of said azo compound of formula (1) and said azo compound of formula (2), and a charge transport layer comprising said polycarbonate resin, said charge transport layer being overlaid on said charge generation layer.

5. The electrophotographic photoconductor as claimed in claim 2, wherein said photoconductive layer comprises a charge generation layer comprising said azo compound of formula (1), and a charge transport layer comprising said polycarbonate resin, said charge transport layer being overlaid on said charge generation layer.

6. The electrophotographic photoconductor as claimed in claim 3, wherein said photoconductive layer comprises a charge generation layer comprising said azo compound of formula (2), and a charge transport layer comprising said polycarbonate resin, said charge transport layer being overlaid on said charge generation layer.

7. The electrophotographic photoconductor as claimed in claim 1, wherein said polycarbonate resin is a high-molecular weight charge transport material represented by formula (3):

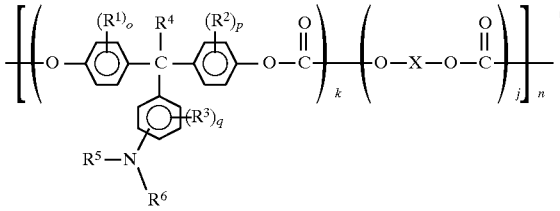

(3)

wherein $R^1$, $R^2$ and $R^3$ are each independently an alkyl group which may have a substituent or a halogen atom; $R^4$ is hydrogen atom or an alkyl group which may have a substituent; $R^5$ and $R^6$ are each independently an aryl group which may have a substituent; o, p and q are each independently an integer of 0 to 4; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

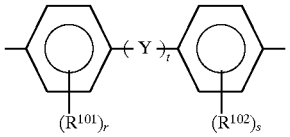

(3-a)

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

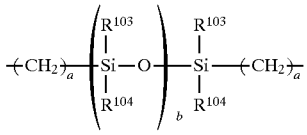

(3-b)

in which a is an integer of 1 to 20; b is an integer of 1 to 2,000; and $R^{103}$ and $R^{104}$, which may be the same or different, are each independently an alkyl group which may have a substituent or an aryl group which may have a substituent.

8. The electrophotographic photoconductor as claimed in claim 1, wherein said polycarbonate resin is a high-molecular weight charge transport material represented by formula (4):

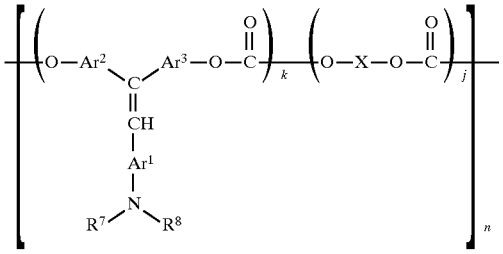

(4)

wherein $R^7$ and $R^8$ are each independently an aryl group which may have a substituent; $Ar^1$, $Ar^2$ and $Ar^3$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

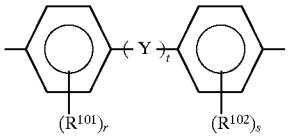

(3-a)

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

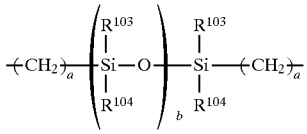

(3-b)

in which a is an integer of 1 to 20; b is an integer of 1 to 2,000; and $R^{103}$ and $R^{104}$, which may be the same or different, are each independently an alkyl group which may have a substituent or an aryl group which may have a substituent.

9. The electrophotographic photoconductor as claimed in claim 1, wherein said polycarbonate resin is a high-molecular weight charge transport material represented by formula (5):

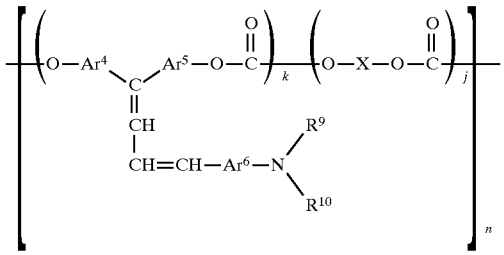

(5)

wherein $R^9$ and $R^{10}$ are each independently an aryl group which may have a substituent; $Ar^4$, $Ar^5$ and $Ar^6$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

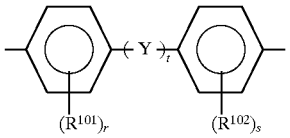

(3-a)

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

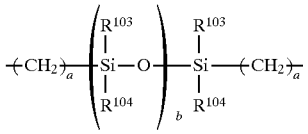

(3-b)

in which a is an integer of 1 to 20; b is an integer of 1 to 2,000; and $R^{103}$ and $R^{104}$, which may be the same or different, are each independently an alkyl group which may have a substituent or an aryl group which may have a substituent.

10. The electrophotographic photoconductor as claimed in claim 1, wherein said polycarbonate resin is a high-molecular weight charge transport material represented by formula (6):

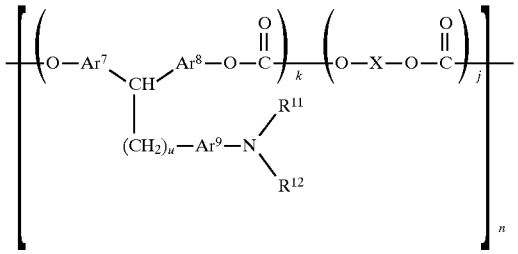

(6)

wherein $R^{11}$ and $R^{12}$ are each independently an aryl group which may have a substituent; $Ar^7$, $Ar^8$ and $Ar^9$, which may be the same or different, are each independently an arylene group; u is an integer of 1 to 5; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

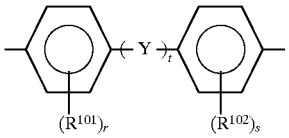

(3-a)

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

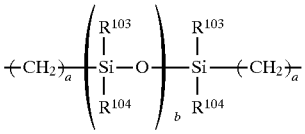

(3-b)

in which a is an integer of 1 to 20; b is an integer of 1 to 2,000; and $R^{103}$ and $R^{104}$, which may be the same or different, are each independently an alkyl group which may have a substituent or an aryl group which may have a substituent.

11. The electrophotographic photoconductor as claimed in claim 1, wherein said polycarbonate resin is a high-molecular weight charge transport material represented by formula (7):

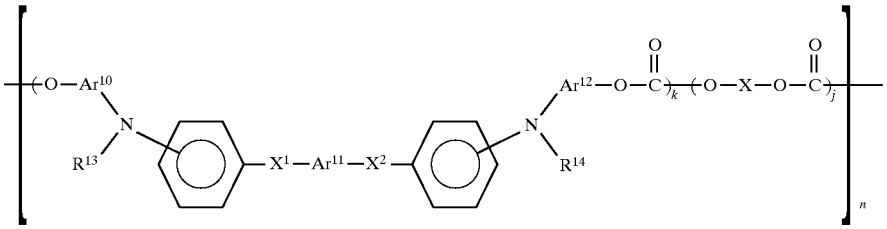

(7)

wherein $R^{13}$ and $R^{14}$ are each independently an aryl group which may have a substituent; $Ar^{10}$, $Ar^{11}$ and $Ar^{12}$, which may be the same or different, are each independently an arylene group; $X^1$ and $X^2$ are each independently ethylene group which may have a substituent or vinylene group which may have a substituent; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

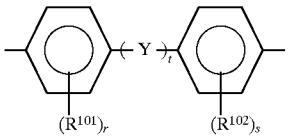

(3-a)

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

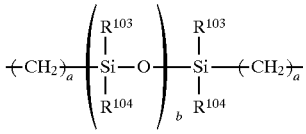

(3-b)

in which a is an integer of 1 to 20; b is an integer of 1 to 2,000; and $R^{103}$ and $R^{104}$, which may be the same or different, are each independently an alkyl group which may have a substituent or an aryl group which may have a substituent.

12. The electrophotographic photoconductor as claimed in claim 1, wherein said polycarbonate resin is a high-molecular weight charge transport material represented by formula (8):

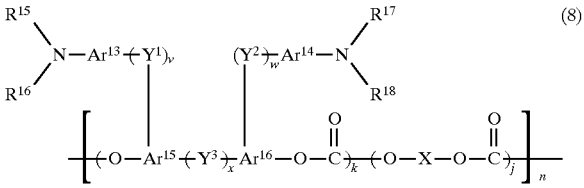

(8)

wherein $R^{15}$, $R^{16}$, $R^{17}$ and $R^{18}$ are each independently an aryl group which may have a substituent; $Ar^{13}$, $Ar^{14}$, $Ar^{15}$ and $Ar^{16}$, which may be the same or different, are each independently an arylene group; v, w and x are each independently an integer of 0 or 1, and when v, w and x are an integer of 1, $Y^1$, $Y^2$ and $Y^3$, which may be the same or different, are each independently an alkylene group which may have a substituent, a cycloalkylene group which may have a substituent, an alkylene ether group which may have a substituent, oxygen atom, sulfur atom, or vinylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

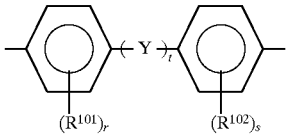

(3-a)

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

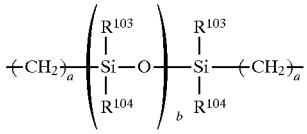

(3-b)

in which a is an integer of 1 to 20; b is an integer of 1 to 2,000; and $R^{103}$ and $R^{104}$, which may be the same or different, are each independently an alkyl group which may have a substituent or an aryl group which may have a substituent.

13. The electrophotographic photoconductor as claimed in claim 1, wherein said polycarbonate resin is a high-molecular weight charge transport material represented by formula (9):

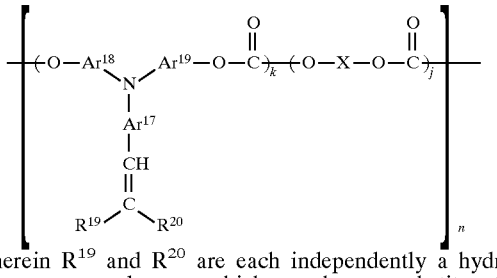

(9)

wherein $R^{19}$ and $R^{20}$ are each independently a hydrogen atom, or an aryl group which may have a substituent, and $R^{19}$ and $R^{20}$ may form a ring in combination; $Ar^{17}$, $Ar^{18}$ and $Ar^{19}$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

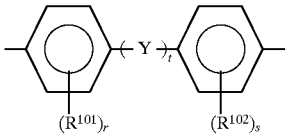

(3-a)

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

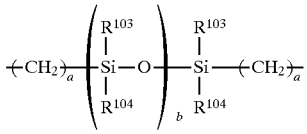

(3-b)

in which a is an integer of 1 to 20; b is an integer of 1 to 2,000; and $R^{103}$ and $R^{104}$, which may be the same or different, are each independently an alkyl group which may have a substituent or an aryl group which may have a substituent.

14. The electrophotographic photoconductor as claimed in claim 1, wherein said polycarbonate resin is a high-molecular weight charge transport material represented by formula (10):

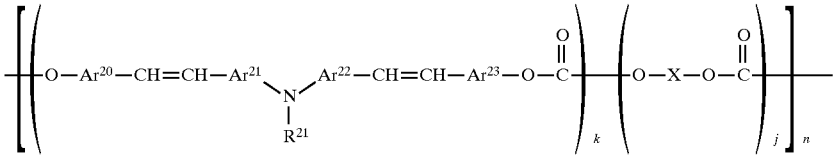

(10)

wherein $R^{21}$ is an aryl group which may have a substituent; $Ar^{20}$, $Ar^{21}$, $Ar^{22}$ and $Ar^{23}$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

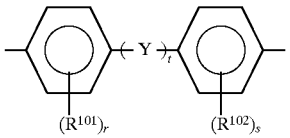

(3-a)

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

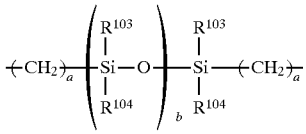

(3-b)

in which a is an integer of 1 to 20; b is an integer of 1 to 2,000; and $R^{103}$ and $R^{104}$, which may be the same or different, are each independently an alkyl group which may have a substituent or an aryl group which may have a substituent.

15. The electrophotographic photoconductor as claimed in claim 1, wherein said polycarbonate resin is a high-molecular weight charge transport material represented by formula (11):

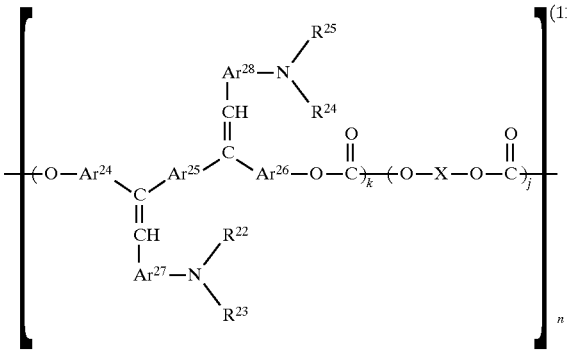

(11)

wherein $R^{22}$, $R^{23}$, $R^{24}$ and $R^{25}$ are each independently an aryl group which may have a substituent; $Ar^{24}$, $Ar^{25}$, $Ar^{26}$, $Ar^{27}$ and $Ar^{28}$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

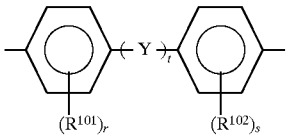

(3-a)

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

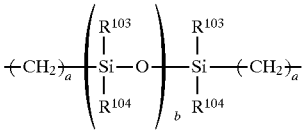

(3-b)

in which a is an integer of 1 to 20; b is an integer of 1 to 2,000; and $R^{103}$ and $R^{104}$, which may be the same or different, are each independently an alkyl group which may have a substituent or an aryl group which may have a substituent.

16. The electrophotographic photoconductor as claimed in claim 1, wherein said polycarbonate resin is a high-molecular weight charge transport material represented by formula (12):

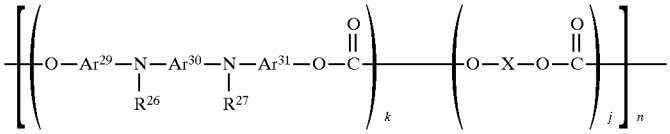

(12)

wherein $R^{26}$ and $R^{27}$ are each independently an aryl group which may have a substituent; $Ar^{29}$, $Ar^{30}$ and $Ar^{31}$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

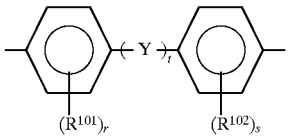

(3-a)

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or

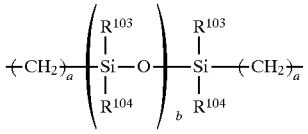

(3-b)

in which a is an integer of 1 to 20; b is an integer of 1 to 2,000; and $R^{103}$ and $R^{104}$, which may be the same or different, are each independently an alkyl group which may have a substituent or an aryl group which may have a substituent.

* * * * *

UNITED STATES PATENT AND TRADEMARK OFFICE

CERTIFICATE OF CORRECTION

PATENT NO. : 5,853,935
DATED : December 29, 1998
INVENTOR(S) : Tetsuro Suzuki, et al.

It is certified that error appears in the above-identified patent and that said Letters Patent is hereby corrected as shown below:

Column 5,
Line 5, "synthesize" should read -- synthesized --.

Column 11,
Line 65 "as those $Y^{202}$." should read -- as those for $Y^{202}$. --.

Column 31
Line 20, "dichioroethane" should read -- dichloroethane --.

Column 33,
Line 25, arylmercap to" should read -- arylmercapto --.

Column 34,
Line 33, "(4hydroxybenzoate)," should read -- (4-hydroxybenzoate), --.

Column 37,
Line 12, "high-molecular/" should read -- high-molecular --.

UNITED STATES PATENT AND TRADEMARK OFFICE

CERTIFICATE OF CORRECTION

PATENT NO. : 5,853,935
DATED : December 29, 1998
INVENTOR(S) : Tetsuro Suzuki, et al.

It is certified that error appears in the above-identified patent and that said Letters Patent is hereby corrected as shown below:

Column 42,
Line 28, "dial" should read -- diol --.
Line 32, "dial" should read -- diol --.

Column 48,
Line 4, "4,4'butylidenebis-" should read -- 4,4'-butylidenebis --.

Signed and Sealed this

Seventh Day of August, 2001

*Attest:*

Nicholas P. Godici

*Attesting Officer*

NICHOLAS P. GODICI
*Acting Director of the United States Patent and Trademark Office*